US011845169B2

(12) United States Patent
Furusawa et al.

(10) Patent No.: US 11,845,169 B2
(45) Date of Patent: Dec. 19, 2023

(54) IMPACT TOOL

(71) Applicant: MAKITA CORPORATION, Anjo (JP)

(72) Inventors: Masanori Furusawa, Anjo (JP); Kanako Hirono, Anjo (JP); Kei Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/846,307

(22) Filed: Jun. 22, 2022

(65) Prior Publication Data

US 2022/0314413 A1 Oct. 6, 2022

Related U.S. Application Data

(63) Continuation of application No. 16/884,687, filed on May 27, 2020, now Pat. No. 11,400,577.

(30) Foreign Application Priority Data

Jun. 11, 2019 (JP) ..... 2019-109085
Jun. 11, 2019 (JP) ..... 2019-109086
Jun. 11, 2019 (JP) ..... 2019-109087

(51) Int. Cl.
*B25D 17/04* (2006.01)
*B25D 11/12* (2006.01)
(Continued)

(52) U.S. Cl.
CPC ..... *B25D 17/043* (2013.01); *B25D 11/12* (2013.01); *B25D 17/24* (2013.01); *B25D 17/20* (2013.01);
(Continued)

(58) Field of Classification Search
CPC ..... B25D 17/043; B25D 17/24; B25D 11/12; B25D 17/20; B25D 2211/068;
(Continued)

(56) References Cited

U.S. PATENT DOCUMENTS 6,076,616 A 6/2000 Kramp et al.
6,766,868 B2 7/2004 Frauhammer et al.
(Continued)

FOREIGN PATENT DOCUMENTS

CN 102069484 A 5/2011
CN 102528769 A 7/2012
(Continued)

OTHER PUBLICATIONS

Jan. 10, 2023 Office Action issued in Japanese Application No. 2019-109085.
(Continued)

*Primary Examiner* — Andrew M Tecco
*Assistant Examiner* — Nicholas E Igbokwe
(74) *Attorney, Agent, or Firm* — Oliff PLC

(57) ABSTRACT

An impact tool includes a motor, a driving mechanism, a tool body, an elastically-connected part elastically connected to the tool body to be movable at least in a front-rear direction relative to the tool body, a detecting mechanism configured to detect pressing of a tool accessory against a workpiece, and a control part configured to control driving of the motor based on a detection result of the detecting mechanism. The detecting mechanism includes a movable member that is provided in one of the tool body and the elastically-connected part and configured to be moved by relative movement of the other of the tool body and the elastically-connected part in the front-rear direction, and a detector that is provided in the one of the tool body and the elastically-connected part and configured to detect rearward pressing of the tool accessory by detecting movement of the movable member.

13 Claims, 13 Drawing Sheets

(51) Int. Cl.
*B25D 17/24* (2006.01)
*B25D 17/20* (2006.01)

(52) U.S. Cl.
CPC ..... *B25D 2211/068* (2013.01); *B25D 2217/0061* (2013.01); *B25D 2250/085* (2013.01); *B25D 2250/121* (2013.01); *B25D 2250/221* (2013.01)

(58) Field of Classification Search
CPC ..... B25D 2217/0061; B25D 2250/085; B25D 2250/121; B25D 2250/221
See application file for complete search history.

(56) References Cited

U.S. PATENT DOCUMENTS

| | | | | |
|---|---|---|---|---|
| 2009/0032275 | A1* | 2/2009 | Ikuta | B25D 17/24 173/210 |
| 2009/0223693 | A1* | 9/2009 | Aoki | B25D 16/00 173/211 |
| 2010/0132969 | A1* | 6/2010 | Bito | F16F 7/1017 173/162.2 |
| 2011/0114347 | A1 | 5/2011 | Kasuya et al. | |
| 2011/0155405 | A1* | 6/2011 | Aoki | B25D 17/245 173/162.2 |
| 2012/0031638 | A1 | 2/2012 | Kamegai et al. | |
| 2012/0068633 | A1 | 3/2012 | Watanabe et al. | |
| 2013/0025895 | A1 | 1/2013 | Friedrich | |
| 2014/0174777 | A1* | 6/2014 | Kakiuchi | B25F 5/006 173/117 |
| 2015/0158170 | A1 | 6/2015 | Nitsche et al. | |
| 2015/0328759 | A1* | 11/2015 | Ikuta | B25D 11/04 173/179 |
| 2016/0129576 | A1 | 5/2016 | Nishikawa et al. | |
| 2017/0106518 | A1 | 4/2017 | Takeuchi et al. | |
| 2018/0099391 | A1 | 4/2018 | Umemoto et al. | |
| 2018/0099396 | A1 | 4/2018 | Iida et al. | |
| 2018/0126534 | A1 | 5/2018 | Iida et al. | |
| 2018/0297186 | A1 | 10/2018 | Iida et al. | |
| 2019/0006909 | A1 | 1/2019 | Nagahama | |

FOREIGN PATENT DOCUMENTS

| | | | |
|---|---|---|---|
| CN | 104364057 | A | 2/2015 |
| CN | 107914245 | A | 4/2018 |
| CN | 109202822 | A | 1/2019 |
| JP | 2011-104736 | A | 6/2011 |
| JP | 2012-035335 | A | 2/2012 |
| JP | 2018-047530 | A | 3/2018 |
| JP | 2018-058188 | A | 4/2018 |
| JP | 2018-079557 | A | 5/2018 |
| JP | 2018-176411 | A | 11/2018 |

OTHER PUBLICATIONS

Apr. 13, 2023 Office Action issued in Chinese Patent Application No. 202010506879.2.

* cited by examiner

IMPACT TOOL

CROSS-REFERENCE TO RELATED APPLICATIONS

This is a Continuation of U.S. patent application Ser. No. 16/884,687 filed May 27, 2020, which claims priority to Japanese patent application No. 2019-109085 filed on Jun. 11, 2019, Japanese patent application No. 2019-109086 filed on Jun. 11, 2019, and Japanese patent application No. 2019-109087 filed on Jun. 11, 2019. The contents of the foregoing applications are fully incorporated herein by reference.

TECHNICAL FIELD

The present disclosure relates to an impact tool which is configured to linearly drive a tool accessory.

BACKGROUND ART

An impact tool is known which is configured to perform a processing operation on a workpiece by linearly driving a tool accessory along a specified driving axis. In such an impact tool, a motor may be controlled to be driven at low speed in a state in which the tool accessory is not pressed against a workpiece and no load is applied (hereinafter referred to as an unloaded state), while being controlled to be driven at higher speed in a state in which the tool accessory is pressed against a workpiece and a load is applied (hereinafter referred to as a loaded state). For example, Japanese Unexamined Patent Application Publication No. 2018-58188 discloses a hammer drill which determines whether or not load is being applied to an output shaft, based on acceleration detected by an acceleration-detection part provided in a housing, and controls driving of a motor accordingly.

SUMMARY

The present disclosure provides an impact tool which is configured to perform a processing operation on a workpiece by linearly driving a tool accessory. The impact tool includes a motor, a driving mechanism, a tool body, an elastically-connected part, a detecting mechanism and a control part.

The driving mechanism is configured to linearly drive the tool accessory along a driving axis by power of the motor. The driving axis defines a front-rear direction of the impact tool. The tool body houses the motor and the driving mechanism. The elastically-connected part is elastically connected to the tool body so as to be movable at least in the front-rear direction relative to the tool body. The term "elastically connected" herein can also be rephrased as "connected via at least one elastic member". Further, the elastically-connected part includes a grip part to be held by a user. The detecting mechanism is configured to detect pressing of the tool accessory against the workpiece. The control part is configured to control driving of the motor based on a detection result of the detecting mechanism. The detecting mechanism includes a movable member and a detector. The movable member is provided in one of the tool body and the elastically-connected part. The movable member is configured to be moved by relative movement of the other of the tool body and the elastically-connected part in the front-rear direction. The detector is provided in the one of the tool body and the elastically-connected part. The detector is configured to detect pressing of the tool accessory by detecting movement of the movable member.

DETAILED DESCRIPTION OF THE EMBODIMENTS

An electric hammer 1 according to an embodiment of the present disclosure is now described with reference to the drawings. The electric hammer (hereinafter simply referred to as a hammer) 1 is an example of an impact tool which is configured to linearly drive a tool accessory 91 along a specified driving axis A1, and may be used for a chipping operation or a scraping operation.

Figure 1:
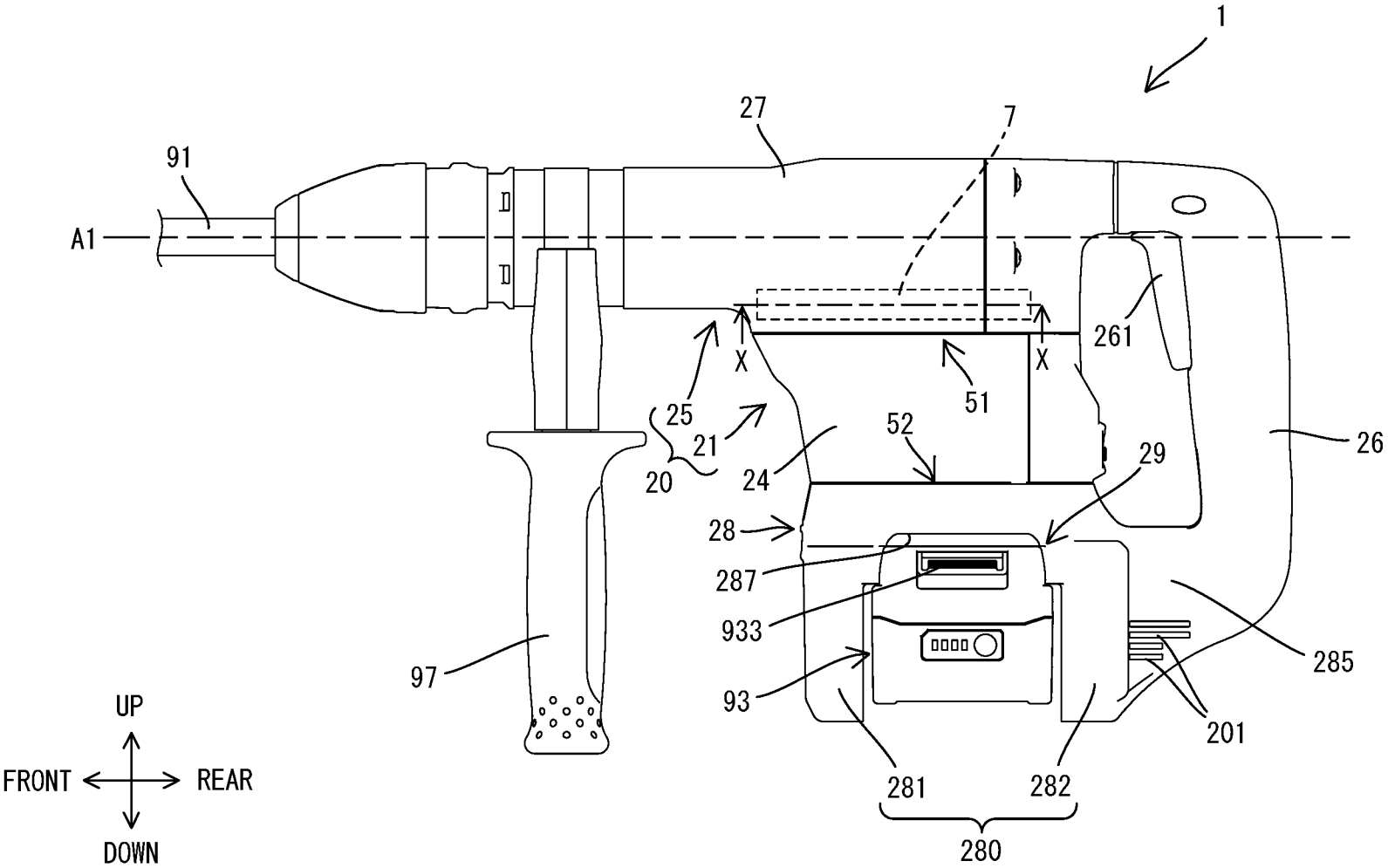
FIG. 1 is a side view showing the overall structure of an electric hammer when viewed from the left.
Figure 2:
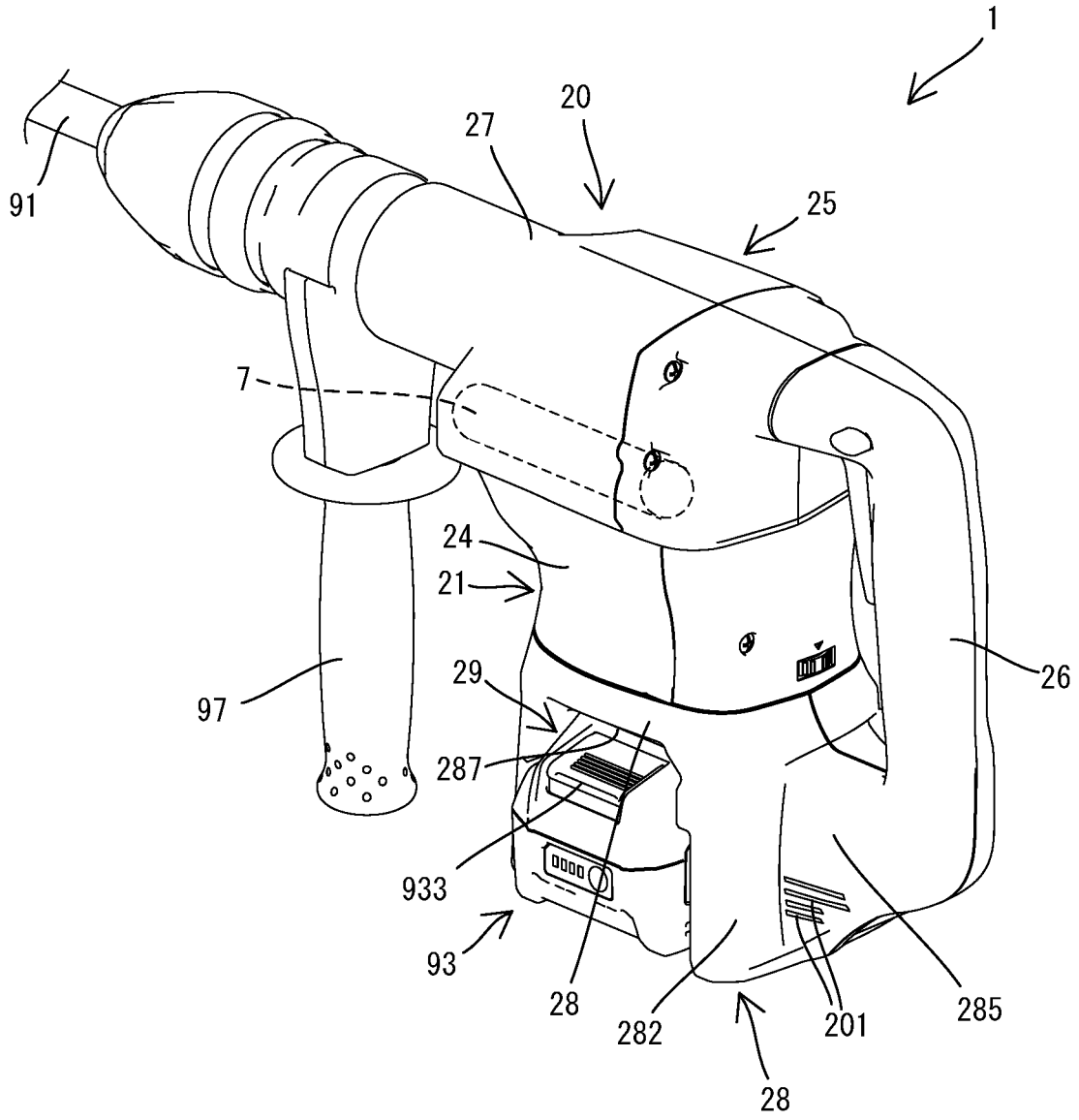
FIG. 2 is a perspective view showing the overall structure of the electric hammer.
Figure 3:
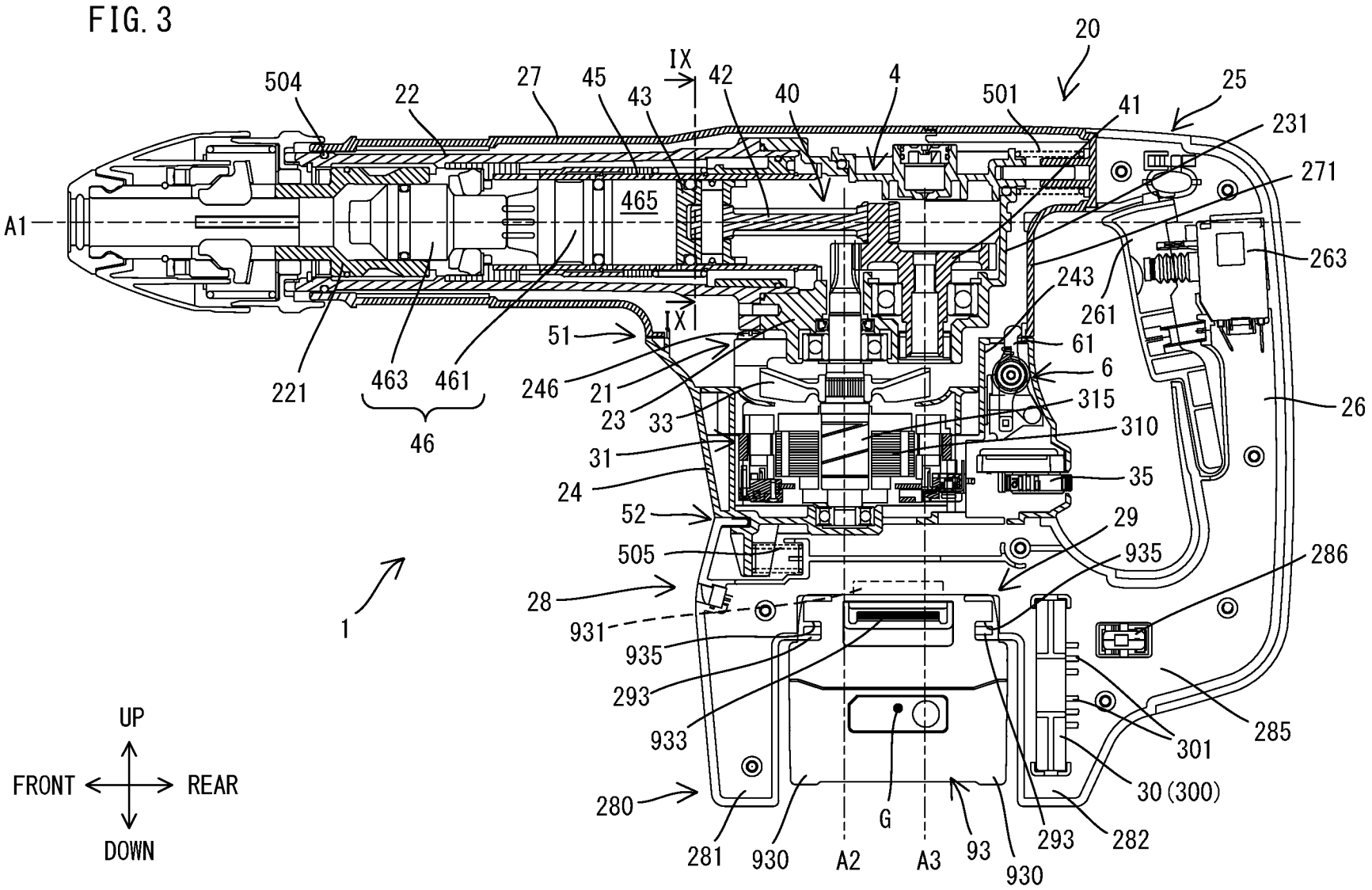
FIG. 3 is a sectional view of the electric hammer when a second housing is located in a rearmost position.

First, the general structure of the hammer 1 is described. As shown in FIGS. 1 to 3, an outer shell of the hammer 1 is mainly formed by a housing 20. The housing 20 of the present embodiment is configured as a so-called vibration-isolating housing. The housing 20 includes a first housing 21 and a second housing 25 which is elastically connected to the first housing 21 so as to be movable relative to the first housing 21.

As shown in FIG. 3, the first housing 21 is generally L-shaped in a side view as a whole. The first housing 21 includes a barrel part 22, a crank housing 23 and a motor housing 24 which are formed separately and connected together.

The barrel part 22 has a circular cylindrical shape and extends along the driving axis A1. A tool holder 221 is disposed within one end portion of the barrel part 22 in an axial direction. The tool accessory 91 may be removably coupled to the tool holder 221. The crank housing 23 is a hollow body having an internal space. The crank housing 23 is fixedly connected to the other end portion of the barrel part 22 in the axial direction. A driving mechanism 4 is housed across the barrel part 22 and the crank housing 23. The motor housing 24 is arranged to protrude in a direction crossing the driving axis A1 and away from the driving axis A1, and is fixedly connected to the crank housing 23. The motor housing 24 houses a motor 31. A rotation axis A2 of a motor shaft 315 is orthogonal to the driving axis A1.

In the following description, for convenience sake, an extending direction of the driving axis A1 of the hammer 1 is defined as a front-rear direction of the hammer 1. In the front-rear direction, one end side of the hammer 1 on which the tool holder 221 is disposed is defined as a front side (also referred to as a front end region side) of the hammer 1 and the opposite side is defined as a rear side. Further, an extending direction of the rotation axis A2 of the motor shaft 315 is defined as an up-down direction of the hammer 1. In the up-down direction, a direction toward which the motor housing part 24 protrudes from the crank housing 23 is defined as a downward direction and the opposite direction is defined as an upward direction. Further, a direction which is orthogonal to the front-rear direction and to the up-down direction is defined as a left-right direction.

As shown in FIGS. 1 to 3, the second housing 25 is a hollow body which is generally U-shaped as a whole. the second housing 25 includes a grip part 26, an upper housing 27 and a lower housing 28.

The grip part 26 is configured to be held by a user and extends generally in the up-down direction. More specifically, the grip part 26 is spaced apart rearward from the first housing 21 and extends generally in the up-down direction. A trigger 261 is provided in a front portion of the grip part 26. The trigger 261 is configured to be depressed (pulled) with a user's finger. The upper housing 27 is connected to an upper end portion of the grip part 26. In the present embodiment, the upper housing 27 extends forward from the upper end portion of the grip part 26, and is configured to cover the barrel part 22 and the crank housing 23 (see FIG. 3) of the first housing 21. The lower housing 28 is connected to a lower end portion of the grip part 26. In the present embodiment, the lower housing 28 extends forward from the lower end portion of the grip part 26, and most of the lower housing 28 is disposed under the motor housing 24. A battery-mounting part 29 is provided on a generally central portion of the lower housing 28 in the front-rear direction. The hammer 1 is powered by a battery 93 which is removably mounted to the battery-mounting part 29.

With the above-described structure, in the hammer 1, the motor housing 24 of the first housing 21 is disposed between the upper housing 27 and the lower housing 28 in the up-down direction, and exposed to the outside as well as the second housing 25. The second housing 25 and the motor housing 24 form an outer surface of the hammer 1.

The detailed structure of the hammer 1 is now described.

First, a vibration-isolating housing structure of the housing 20 is described. As described above, in the housing 20, the second housing 25 including the grip part 26 is elastically connected to the first housing 21 so as to be movable relative to the first housing 21. With this structure, transmission of vibration from the first housing 21 to the second housing 25 can be suppressed.

More specifically, as shown in FIG. 3, an elastic member 501 is disposed between the crank housing 23 of the first housing 21 and the upper housing 27 of the second housing 25. More specifically, a compression coil spring is adopted for the elastic member 501. Further, a spring-receiving part is provided on a rear-wall part 231 which defines a rear end portion of the crank housing 23. Another spring-receiving part is provided inside the upper housing 27 (specifically, a region adjacent to the upper end portion of the grip part 26) to face the spring-receiving part on the rear-wall part 231. These spring-receiving parts are each configured as a projection and respectively fitted in front and rear end portions of the elastic member 501 to support the elastic member 501. Further, an annular elastic member (a so-called O-ring) 504 is disposed between the barrel part 22 of the first housing 21 and a front end portion of the upper housing 27.

An elastic member 505 is disposed between the motor housing 24 of the first housing 21 and the lower housing 28 of the second housing 25. More specifically, a compression coil spring is adopted for the elastic member 505. A lower end portion of the motor housing 24 is partially disposed within the lower housing 28 and has a spring-receiving part. Another spring-receiving part is provided inside the lower housing 28 to face the spring-receiving part of the motor housing 24. These spring-receiving parts are each configured as a recess and respectively receive front and rear end portions of the elastic member 505 to support the elastic member 505.

Each of the elastic members 501 and 505 is arranged such that a working direction of its spring force substantially coincides with the front-rear direction, and biases the first housing 21 and the second housing 25 away from each other (such that the grip part 26 is moved away from the first housing 21) in the extending direction of the driving axis A1. In other words, the first housing 21 and the second housing 25 are biased forward and rearward, respectively.

Figure 4:
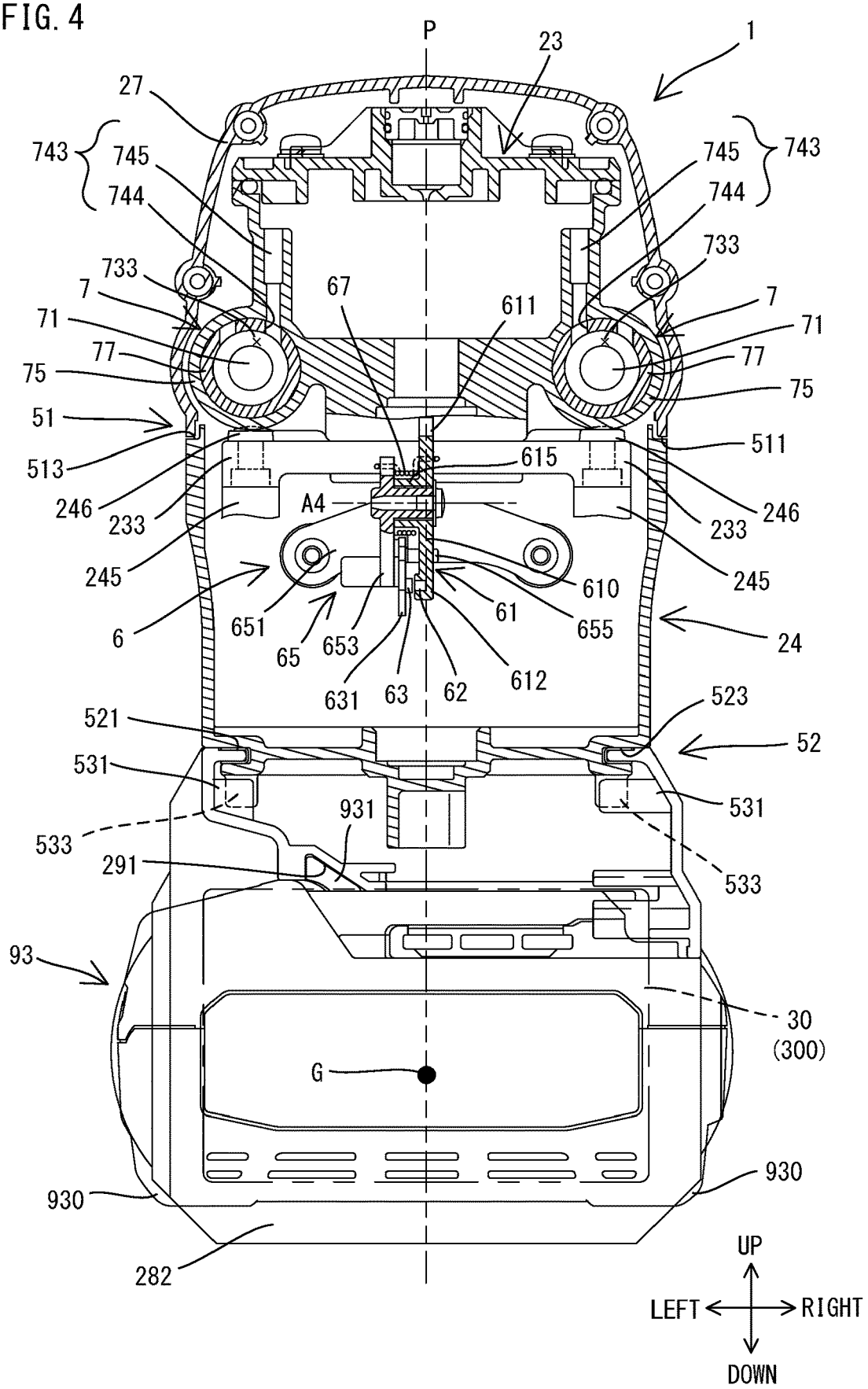
FIG. 4 is a partial sectional view for illustrating an internal structure of the electric hammer.

The upper housing 27 and the lower housing 28 are configured to be slidable relative to upper and lower end portions of the motor housing 24, respectively. More specifically, as shown in FIG. 4, lower end surfaces 511 of right and left side walls of the upper housing 27 and upper end surfaces 513 of right and left side walls of the motor housing 24 are configured as sliding surfaces which are slidable in contact with each other. The lower end surfaces 511 and the upper end surfaces 513 form an upper sliding part 51. Further, a guide rail 521 is provided on each of right and left side walls of the lower housing 28. The guide rail 521 protrudes inward (toward the center of the lower housing 28 in the left-right direction) and extends in the front-rear direction. Further, a guide groove 523 is provided in a lower end portion of each of the right and left side walls of the motor housing 24. The guide groove 523 extends in the front-rear direction. The guide rail 521 is engaged with the guide groove 523 so as to be slidable in the front-rear direction. The guide rails 521 and the guide grooves 523 form a lower sliding part 52. The first housing 21 and the second housing 25 are slidable relative to each other in the front-rear direction in the upper sliding part 51 and the lower sliding part 52.

When the tool accessory 91 is driven along the driving axis A1, vibration is caused in the first housing 21. The largest and most dominant vibration caused in the first housing 21 is a vibration in the front-rear direction. In the present embodiment, the first housing 21 and the second housing 25 which are connected via the elastic members 501, 504, and 505 move in the front-rear direction relative to each other, while sliding in the upper sliding part 51 and the lower sliding part 52, so that transmission of the vibration in the front-rear direction to the second housing 25 (to the grip part 26, in particular) can be effectively suppressed.

The first housing 21 and the second housing 25 are provided with a structure for defining a range of their relative movement in the front-rear direction. More specifically, as shown in FIG. 4, a pair of stopper parts 531 are respectively provided on upper end portions of the right and left side walls of the lower housing 28. Each of the stopper parts 531 protrudes toward the inside of the lower housing 28 and has a recess (not shown). A pair of right and left projections 533 are formed on a lower end portion of the motor housing 24. Each of the projections 533 protrudes downward and is disposed within the recess of the stopper part 531. With such a structure, the first housing 21 and the second housing 25 are allowed to move in the front-rear direction between a position where the projection 533 abuts on a wall surface defining a front end of the recess and a position where the projection 533 abuts on a wall surface defining a rear end of the recess. Thus, the second housing 25 is located at a rearmost position relative to the first housing 21 when the projection 533 abuts on the wall surface defining the front end of the recess, while the second housing 25 is located at a foremost position relative to the first housing 21 when the projection 533 abuts on the wall surface defining the rear end of the recess.

Figure 5:
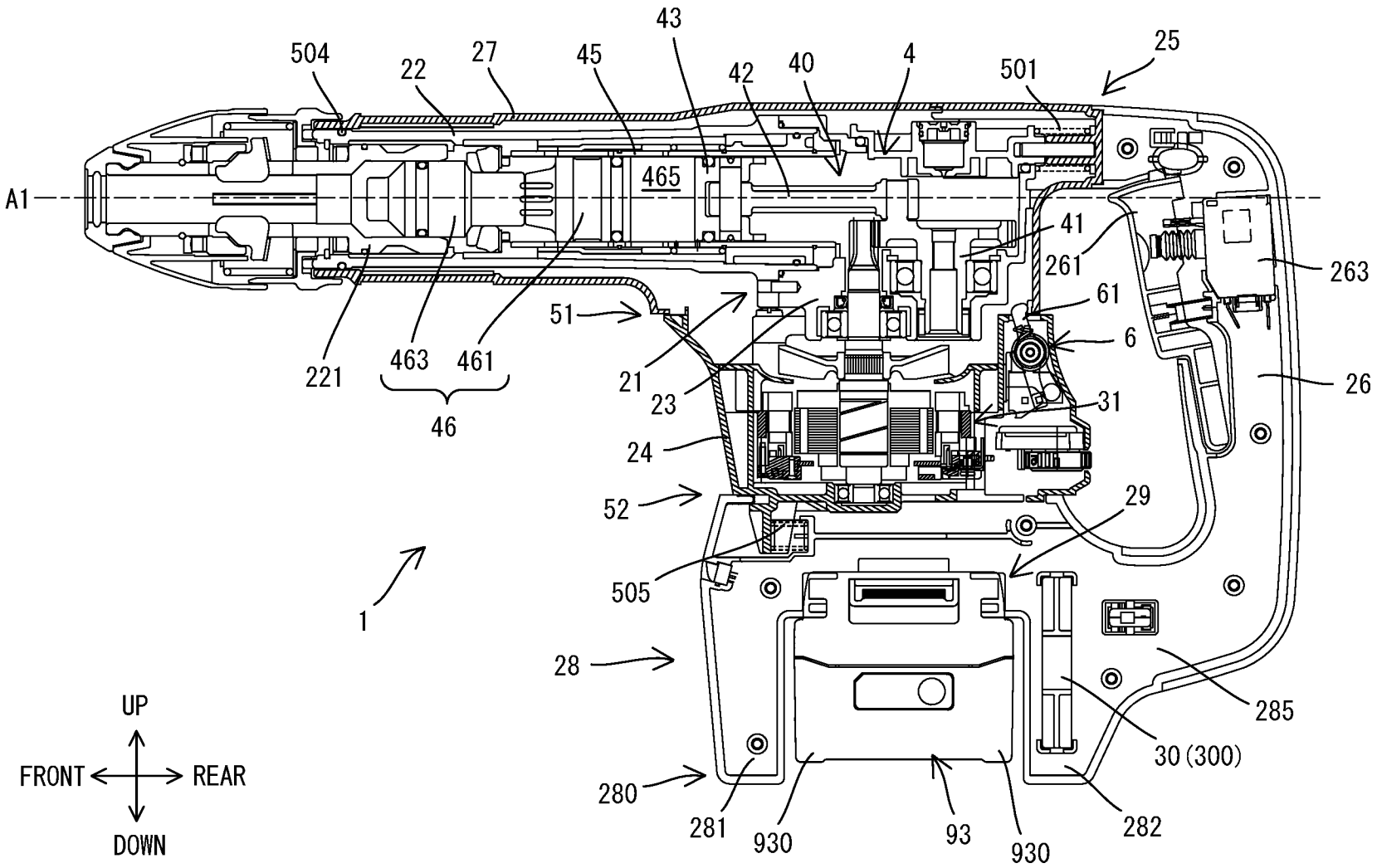
FIG. 5 is a sectional view of the electric hammer when the second housing is located in a foremost position.

As described above, the first housing 21 and the second housing 25 are biased forward and rearward, respectively, by the elastic members 501 and 505. With such a structure, in an initial state, the second housing 25 is held in the rearmost position relative to the first housing 21. The rearmost position of the second housing 25 is hereinafter also referred to as an initial position. When the second housing 25 is in the initial position, as shown in FIGS. 1 and 3, in the front-rear direction, the position of an upper rear end of the motor housing 24 substantially coincides with the position of a lower rear end of a rear-wall part 271 of the upper housing 27 which covers a rear end portion of the crank housing 23, and the position of a lower front end of the motor housing 24 substantially coincides with the position of an upper front end of the lower housing 28. When the second housing 25 is placed in the foremost position relative to the first housing 21, as shown in FIG. 5, the motor housing 24 is placed in a position displaced rearward from the upper housing 27 and the lower housing 28.

The detailed structure of the first housing 21 and its internal structure are now described.

The motor housing part 24 and its internal structure are first described. As shown in FIGS. 1 to 3, the motor housing part 24 has a bottomed rectangular cylindrical shape having an open upper end. The motor 31, a speed-change-dial unit 35 and a detection unit 6 are housed in the motor housing 24.

In the present embodiment, a brushless DC motor is adopted for the motor 31. The motor 31 includes a motor body 310 and a motor shaft 315. The motor body 310 includes a stator and a rotor. The motor shaft 315 extends from the rotor and rotates together with the rotor. The motor shaft 315 extends in the up-down direction and is rotatably supported at its upper and lower end portions by bearings. A fan 33 is disposed between the motor body 310 and the upper bearing. The fan 33 is fixed onto the motor shaft 315 and rotates together with the motor shaft 315. The fan 33 is configured to generate an air flow which is led into the housing 20 through inlets 201 (see FIG. 1) and flows around the motor 31 while cooling the motor 31 and then flows out of the housing 20 through outlets (not shown). A driving gear is formed on an upper end portion of the motor shaft 315 which protrudes into the crank housing 23. The driving gear is engaged with a driven gear of a crank shaft 41.

The speed-change-dial unit 35 is disposed behind the motor body 310 in a lower end portion of the motor housing 24. The speed-change-dial unit 35 is a device which is configured to receive a setting input of the rotation speed of the motor 31 in response to a user's external operation. Although not shown in detail, the speed-change-dial unit 35 includes a dial. The dial is an operation member to be rotated from the outside of the motor housing 24 by a user. The speed-change-dial unit 35 is connected to a controller 30 via a wiring (not shown) and configured to output to the controller 30 a signal indicating a resistance value (in other words, set rotation speed) corresponding to the rotation position of the dial.

Figure 6:
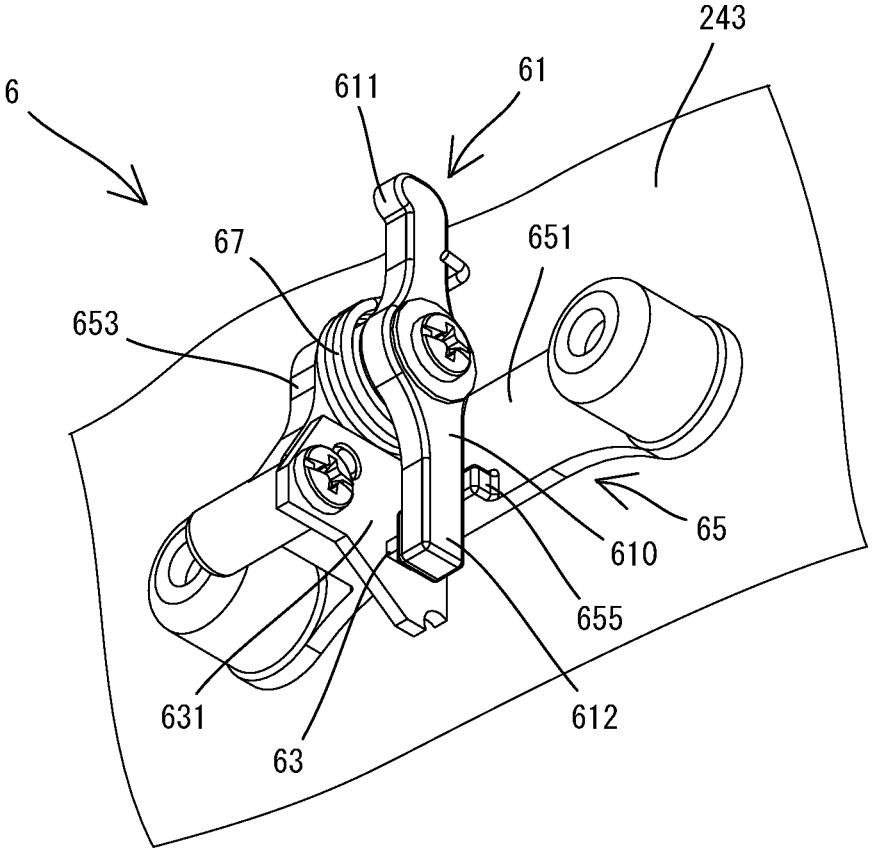
FIG. 6 is a perspective view showing the overall structure of a detection unit.

The detection unit 6 is configured to detect the position of the second housing 25 relative to the first housing 21 in the front-rear direction. As shown in FIGS. 4 and 6, in the present embodiment, the detection unit 6 includes a lever 61, a Hall sensor 63 and a holder 65. The lever 61 and the Hall sensor 63 are assembled to the holder 65 and form the detection unit 6 as a single assembly.

The holder 65 mainly includes a base 651 and a lever-support part 653. The base 651 is an elongate plate-like portion and is fixed to the motor housing 24. The lever-support part 653 is a plate-like portion and protrudes rearward from the back side of the base 651 so as to be orthogonal to the base 651.

The lever 61 includes an elongate plate-like lever arm 610 having two end portions, and a cylindrical part 615 protruding from the lever arm 610. A magnet 62 is fixed on one side of one of the end portions of the lever arm 610. The lever 61 is supported by the lever-support part 653 so as to be rotatable around a rotation axis A4, which extends in the left-right direction. More specifically, the lever-support part 653 has a support shaft protruding to the right from a right side surface of the lever-support part 653. The cylindrical part 615 of the lever 61 is fitted onto the support shaft of the lever-support part 653 and then a screw is screwed and fastened to a female thread part formed in the support shaft, so that the lever 61 is rotatably supported by the lever-support part 635. The other of the two end portions of the lever arm 610 which is on the side opposite to the one end portion with the magnet 62 functions as an end portion to be actuated by the second housing 25 according to relative movement of the second housing 25. This end portion (the end portion to be actuated by the second housing 25) and the other end portion on which the magnet 62 is fixed are hereinafter referred to as a first end portion 611 and a second end portion 612, respectively.

Further, a torsion coil spring 67 is fitted on the cylindrical part 615. One end portion of the torsion coil spring 67 is locked to the lever-support part 653, and the other end portion of the torsion coil spring 67 is locked to the lever arm 610 in the vicinity of the first end portion 611. Thus, the first end portion 611 of the lever 61 is biased away from the base 651 and held in a position in which a portion of the lever 61 in the vicinity of the second end portion 612 abuts on a stopper projection 655 which is formed on the base 651.

The Hall sensor 63 is a well-known sensor having a Hall element, and mounted on a board (circuit board) 631. The board 631 is fixed to the lever-support part 653 via a screw. One side of the board 631 on which the Hall sensor 63 is mounted faces the side of the lever arm 610 on which the magnet 62 is fixed. The Hall sensor 63 is electrically connected to the controller 30 via a wiring (not shown) and configured to output a specific signal (ON signal) to the controller 30 when the magnet 62 is located within a specified detection range.

The detection unit 6 having the above-described structure is fixed to the first housing 21 by the holder 65 being fixed to the motor housing 24. More specifically, an inner-rear-wall part 243 is provided behind the motor 31 within the motor housing 24 (see FIG. 3). The inner-rear-wall part 243 is arranged orthogonally to the front-rear direction. The base 651 is fixed to a back side of an upper end portion of the inner-rear-wall part 243 with screws (not shown) with the second end portion 612 of the lever arm 610 down and the first end portion 611 up.

Figure 7:
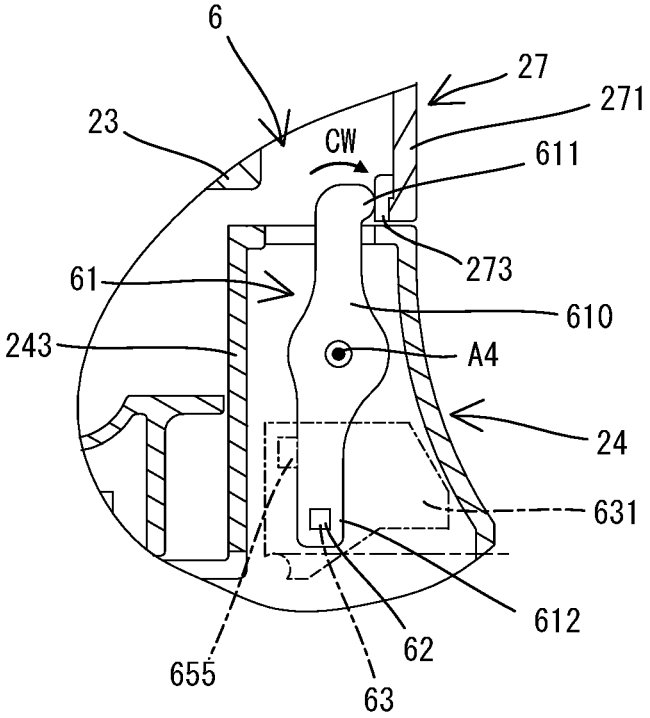
FIG. 7 is an explanatory drawing for illustrating the detection unit when the second housing is located in the rearmost position.

As shown in FIG. 7, the first end portion 611 of the lever arm 610 protrudes into the upper housing 27 (a space between the crank housing 23 and the rear-wall part 271 of the upper housing 27) through an upper end opening of the motor housing 24. An abutment part 273 is provided on a lower end portion of the rear-wall part 271 and protrudes forward. As shown in FIGS. 3 and 7, when the second housing 25 is located in the initial position (the rearmost position) relative to the first housing 21, the lever 61 is held in a position where the portion of the lever 61 in the vicinity of the second end portion 612 abuts on the stopper projection 655. At this time, the first end portion 611 of the lever 61 is located in a rearmost position within its rotatable range, and the first end portion 611 is slightly apart forward from the abutment part 273. The position of the lever 61 at this time is referred to as an initial position of the lever 61. When the lever 61 is located in the initial position, the magnet 62 is located within the detection range of the Hall sensor 63, facing the Hall sensor 63 on the right side of the Hall sensor 63. Therefore, the Hall sensor 63 outputs an ON signal to the controller 30.

Figure 8:
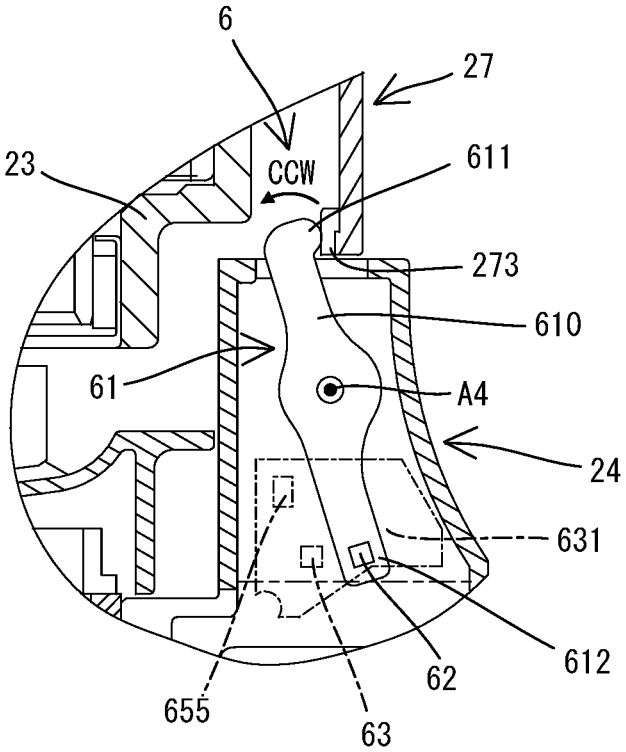
FIG. 8 is an explanatory drawing for illustrating the detection unit when the second housing is located in the foremost position.

As shown in FIGS. 5 and 8, when the second housing 25 moves forward from the initial position relative to the first housing 21, the first end portion 611 is pressed forward by the abutment part 273, against a biasing force of the torsion coil spring 67, so that the lever 61 is turned from the initial position in a counterclockwise (a direction shown by arrow CCW in FIG. 8) direction as viewed from the left. Thus, the lever 61 is turned along with forward relative movement of the second housing 25. When the second housing 25 moves forward from the initial position to a specified position relative to the first housing 21, the lever 61 is also turned from the initial position by a specified angle and is placed in a corresponding specified position. During this process, the magnet 62 moves out of the detection range of the Hall sensor 63, and the Hall sensor 63 stops output of the ON signal.

In the present embodiment, the distance between the rotation axis A4 of the lever 61 and the second end portion 612 (specifically, the distance between the rotation axis A4 and the magnet 62) is set to be slightly longer than the distance between the rotation axis A4 and the first end portion 611 (specifically, the distance between the rotation axis A4 and a position of abutment between the first end portion 611 and the abutment part 273). Therefore, when the lever 61 is turned from the initial position to the specified position along with forward relative movement of the second housing 25, movement (an amount of movement) of the second end portion 612 is slightly larger than movement (an amount of movement) of the first end portion 611. Therefore, the magnet 62 can be reliably moved out of the detection range of the Hall sensor 63 by relatively small movement of the second housing 25.

The above-described specified position (hereinafter referred to as an OFF position) of the second housing 25 is set slightly rearward of the foremost position (shown in FIG. 8) of the second housing 25 within the movable range. Similarly, the specified position (hereinafter referred to as an OFF position) of the lever 61 is set to a position slightly rearward of a position (shown in FIG. 8) where the first end portion 611 is located in the foremost position within the rotatable range. When the second housing 25 and the lever 61 are respectively located between the respective OFF positions and the respective foremost positions, the Hall sensor 63 dose not output an ON signal.

Detection results of the Hall sensor 63 are used for drive control of the motor 31 by the controller 30, which will be described later in detail.

The crank housing 23, the barrel part 22 and their internal structures are now described.

Figure 9:
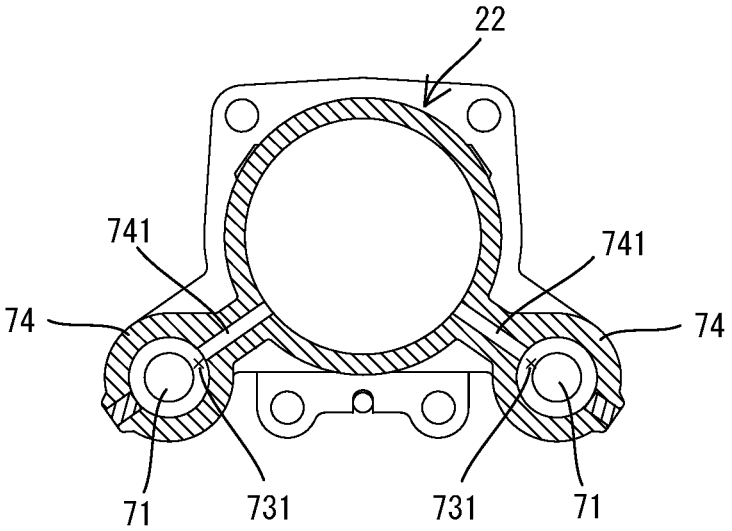
FIG. 9 is a sectional view taken along line IX-IX in FIG. 3 (showing only a barrel part).

The crank housing 23 is a generally rectangular hollow body as shown in FIGS. 3 and 4. The barrel part 22 is an elongate circular cylindrical body as shown in FIGS. 3 and 9. The crank housing 23 and the barrel part 22 are fixedly connected to each other in the front-rear direction with screws (not shown) and form a driving-mechanism-housing part which houses the driving mechanism 4. Further, as shown in FIGS. 3 and 4, a lower end portion of the crank housing 23 is disposed within an upper end portion of the motor housing 24 and fixedly connected to the motor housing 24 with screws 246. Thus, the first housing 21 is formed as a single housing.

The driving mechanism 4 is described. The driving mechanism 4 is configured to perform an operation (hereinafter referred to as a hammering operation) of linearly driving the tool accessory 91 along the driving axis A1 by power of the motor 31. As shown in FIG. 3, the driving mechanism 4 includes a motion-converting mechanism 40 and a striking mechanism 46.

The motion-converting mechanism 40 is configured to convert rotation of the motor shaft 315 into linear motion of a piston 43. In the present embodiment, a crank mechanism having a well-known structure is adopted as the motion-converting mechanism 40. The motion-converting mechanism 40 includes a crank shaft 41, a connecting rod 42, a piston 43 and a cylinder 45.

The crank shaft 41 is disposed behind the motor shaft 315 and extends in the up-down direction. The crank shaft 41 is supported rotatably around a rotation axis A3 by two bearings which are held by the crank housing 23. The rotation axis A3 extends in parallel to the rotation axis A2 of the motor shaft 315 and orthogonally to the driving axis A1. The crank shaft 41 has the driven gear which is engaged with the driving gear of the motor shaft 315, and rotates around the rotation axis A3 along with rotation of the motor shaft 315. Further, the crank shaft 41 has an eccentric pin provided in a position displaced from the rotation axis A3. One end portion of the connecting rod 42 is connected to the eccentric pin, while the other end portion of the connecting rod 42 is connected to the piston 43 via a connecting pin. The cylinder 45 is an elongate circular cylindrical body. The cylinder 45 is housed in the barrel part 22 and extends along the driving axis A1 in the front-rear direction. The piston 43 is slidably disposed within the cylinder 45. The piston 43 reciprocates in the front-rear direction within the cylinder 45 along with rotation of the crank shaft 41.

The striking mechanism 46 is configured to linearly move in the front-rear direction along with reciprocating movement of the piston 43 to thereby apply a striking force to the tool accessory 91. In the present embodiment, the striking mechanism 46 includes a striker 461 and an impact bolt 463. The striker 461 is disposed slidably in the front-rear direction within the cylinder 45. An air chamber 465 is formed between the striker 461 and the piston 43 and serves to linearly move the striker 461 via pressure fluctuations of air caused by the reciprocating movement of the piston 43. The impact bolt 463 is disposed slidably in the front-rear direction within the tool holder 221. The tool holder 221 is held within a front end portion of the barrel part 22.

When the motor 31 is driven and the piston 43 is moved forward, air of the air chamber 465 is compressed so that the internal pressure increases. Therefore, the striker 461 is pushed forward at high speed by the action of an air spring and collides with the impact bolt 463, thereby transmitting its kinetic energy to the tool accessory 91 via the impact bolt 463. The tool accessory 91 is linearly driven along the driving axis A1 by receiving this kinetic energy and strikes a workpiece. On the other hand, when the piston 43 is moved rearward, air of the air chamber 465 expands so that the internal pressure decreases and the striker 461 is retracted rearward. The tool accessory 91 is moved rearward by being pressed against the workpiece. By repeating the hammering operation by the motion-converting mechanism 40 and the striking mechanism 46 in this manner, chipping operation or scraping operation is performed.

Figure 10:
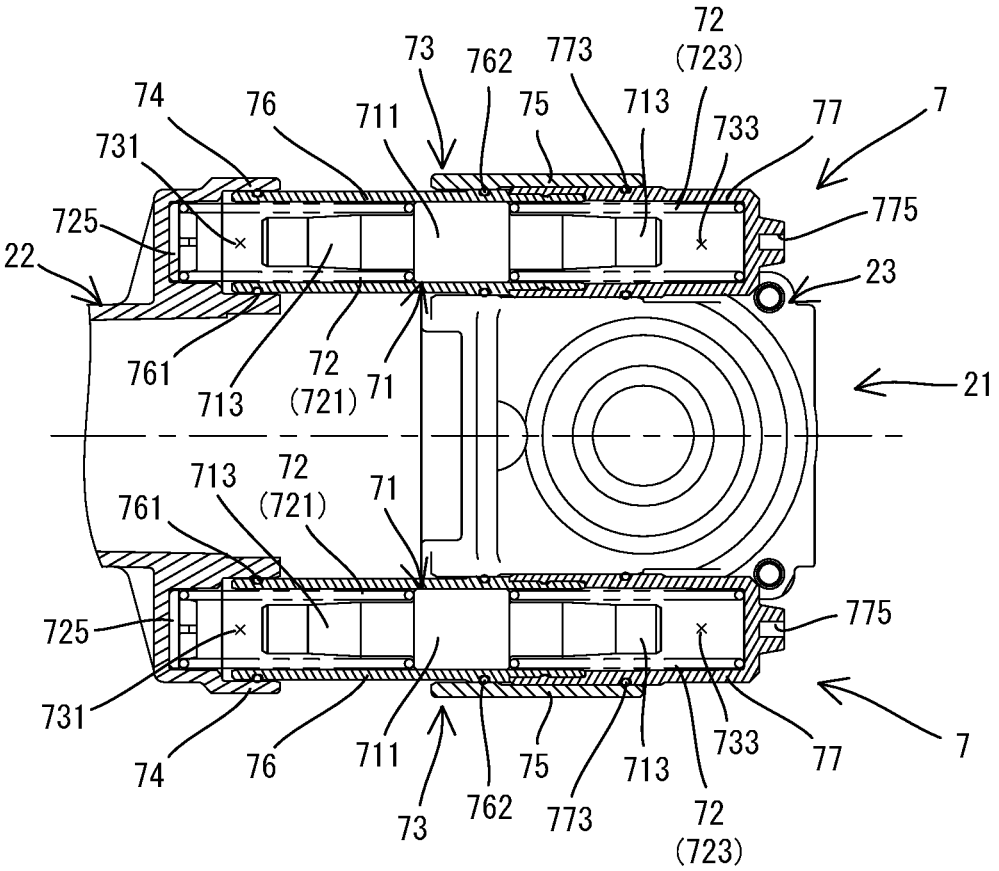
FIG. 10 is a sectional view taken along line X-X in FIG. 1.

As described above, in the hammer 1, a relatively large vibration is caused in the front-rear direction in the first housing 21 when the hammering operation is performed. Therefore, as shown in FIGS. 4 and 10, the hammer 1 of the present embodiment includes a pair of right and left dynamic vibration reducers 7 for absorbing vibration caused in the first housing 21. The dynamic vibration reducers 7 have the same structure and are symmetrically arranged relative to an imaginary plane P. The imaginary plane P is an imaginary plane that includes the driving axis A1 and extends in the up-down direction (or in other words, an imaginary plane that includes the driving axis A1, the rotation axis A2 and the rotation axis A3). Further, as shown in FIG. 1, the dynamic vibration reducers 7 are arranged to extend in the front-rear direction slightly below the driving axis A1 and in parallel to the driving axis A1.

The detailed structure of the dynamic vibration reducers 7 is now described. As shown in FIG. 10, each of the dynamic vibration reducers 7 mainly includes a weight 71, two springs 72 arranged on opposite sides of the weight 71, and a housing part 73 which houses the weight 71 and the springs 72.

The weight 71 is an elongate circular columnar member extending in the front-rear direction. More specifically, the weight 71 has a large-diameter part 711 having a uniform diameter and small-diameter parts 713 each having a smaller diameter than the large-diameter part 711 and respectively protruding from front and rear ends of the large-diameter part 711. The two springs 72 are respectively fitted onto the small-diameter parts 713. One end of each of the springs 72 is held in abutment with an end of the large-diameter part 711. In the following description, the springs 72 are referred, collectively or without distinction, to simply as springs 72. Further, one of the two springs 72 which is disposed in front of the weight 71 is also referred to as a front spring 721, and the other spring 72 which is disposed behind the weight 71 is also referred to as a rear spring 723.

The housing part 73 has a circular cylindrical shape as a whole, having both ends closed, and is formed by connecting a plurality of members. In the present embodiment, the housing part 73 is formed by utilizing a portion of the barrel part 22 and a portion of the crank housing 23. More specifically, the housing part 73 includes a first support part 74 which is a portion of the barrel part 22, a second support part 75 which is a portion of the crank housing 23, a sleeve 76 and a cap 77.

As shown in FIGS. 9 and 10, a pair of the first support parts 74 of the pair of dynamic vibration reducers 7 are provided in a lower rear end portion of the barrel part 22, and protrude to the right and left, respectively. The first support part 74 has a bottomed circular cylindrical shape having a closed front end and an open rear end, with its axis extending in the front-rear direction. In other words, the first support part 74 has a recess having an open rear end. The recess is formed as a stepped recess which includes a front portion and a rear portion. The front portion has a smaller inner diameter than the rear portion.

As shown in FIGS. 4 and 10, the pair of second support parts 75 are provided in a lower central portion of the crank housing 23, and protrude to the right and left, respectively. Further, the second support parts 75 are coaxially arranged with the first support parts 74, respectively, apart rearward from the first support parts 74. The second support part 75 has a circular cylindrical shape having its axis extending in the front-rear direction.

The sleeve 76 is a circular cylindrical body which is separate from the first support part 74 and the second support part 75. The sleeve 76 is a member for securing stable sliding movement of the weight 71 (specifically, the large-diameter part 711) and has an inner diameter substantially equal to the diameter of the large-diameter part 711.

Figure 11:
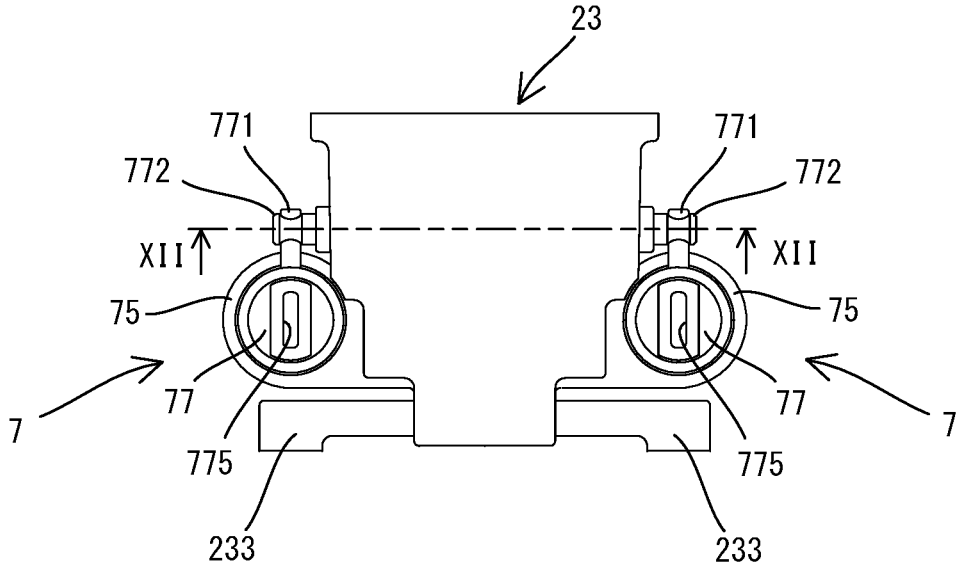
FIG. 11 is a rear view of a crank housing and dynamic vibration reducers.
Figure 12:
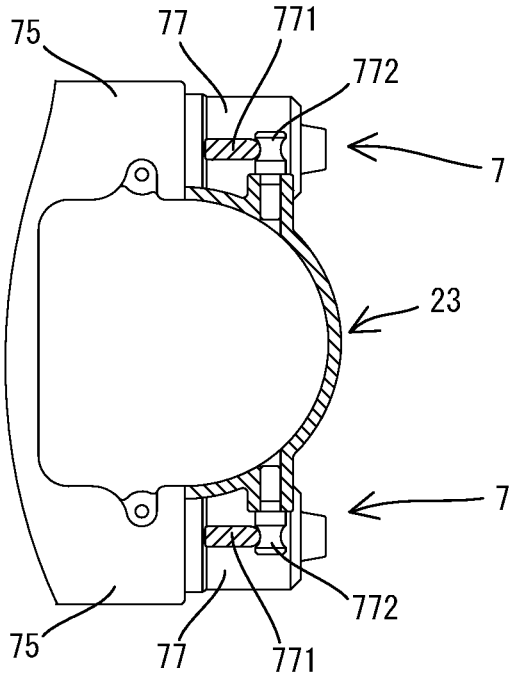
FIG. 12 is a sectional view taken along line XII-XII in FIG. 11.

The cap 77 has a bottomed circular cylindrical shape having a closed rear end and an open front end. The cap 77 is coaxially fitted and connected onto a rear end portion of the sleeve 76, and closes the rear open end of the sleeve 76. As shown in FIGS. 11 and 12, a projection 771 protrudes radially outward from a rear end portion of the cap 77.

As shown in FIG. 10, the sleeve 76 and the cap 77 are coaxially supported by the first support part 74 and the second support part 75. More specifically, a front end portion of the sleeve 76 is inserted in the large-diameter part of the recess of the first support part 74. Further, the rear end portion of the sleeve 76 and a front portion of the cap 77 are inserted in the second support part 75. A rear portion of the cap 77 protrudes rearward from the second support part 75. With such a structure, the housing part 73 having a circular columnar internal space (housing space) is formed. Further, an O-ring 761 is fitted onto the front end portion of the sleeve 76 in order to seal a gap between an inner peripheral surface of the first support part 74 and an outer peripheral surface of the sleeve 76. An O-ring 762 is fitted onto the rear end portion of the sleeve 76 in order to seal a gap between an inner peripheral surface of the second support part 75 and the outer peripheral surface of the sleeve 76. Further, an O-ring 773 is fitted onto a central portion of the cap 77 in order to seal a gap between the inner peripheral surface of the second support part 75 and an outer peripheral surface of the cap 77.

The weight 71 and the springs 72 are disposed in the internal space of the housing part 73 such that the springs 72 are compressed and the large-diameter part 711 of the weight 71 is allowed to slide within the sleeve 76 while being subject to biasing forces of the springs 72. Further, the sleeve 76 and the cap 77 are fixedly held by the crank housing 23 by utilizing the biasing forces of the springs 72.

More specifically, a spring-receiving member 725 is fitted into a front end portion of the front spring 721. The spring-receiving member 725 is fitted into the small-diameter part of the recess of the first support part 74 and held in abutment with a bottom of the recess. A rear end of the rear spring 723 is held in abutment with the cap 77. In the present embodiment, when the springs 72 are compressed, the sleeve 76 and the cap 77 are biased rearward, but the sleeve 76 and the cap 77 are restricted from moving rearward by a stopper pin 772 fixed to the crank housing 23 and held in a specified position. Specifically, as shown in FIGS. 11 and 12, the projection 771 of the cap 77 is arranged to protrude upward and is locked by abutting on the stopper pin 772 from the front. Thus, the sleeve 76 and the cap 77 are positioned in the front-rear direction and held in that position. A pair of stopper pins 772 are respectively provided behind and above the second support parts 75. The stopper pins 772 respectively protrude from the right and left side walls of the crank housing 23 to the right and left. With such a structure, the first support part 74 receives a forward biasing force of the springs 72 via the spring-receiving member 725, and the stopper pin 772 receives a rearward biasing force of the springs 72 via the cap 77.

The stopper pin 772 has a central portion recessed in a curved form. The projection 771 has a rear end surface conforming to the shape of the recess of the stopper pin 772. When the projection 771 is engaged with the recess of the stopper pin 772, the cap 77 is positioned not only in the front-rear direction but also in a circumferential direction around an axis of the housing part 73 relative to the crank housing 23, and held in that position.

In the present embodiment, the dynamic vibration reducer 7 may be assembled as follows.

Figure 13:
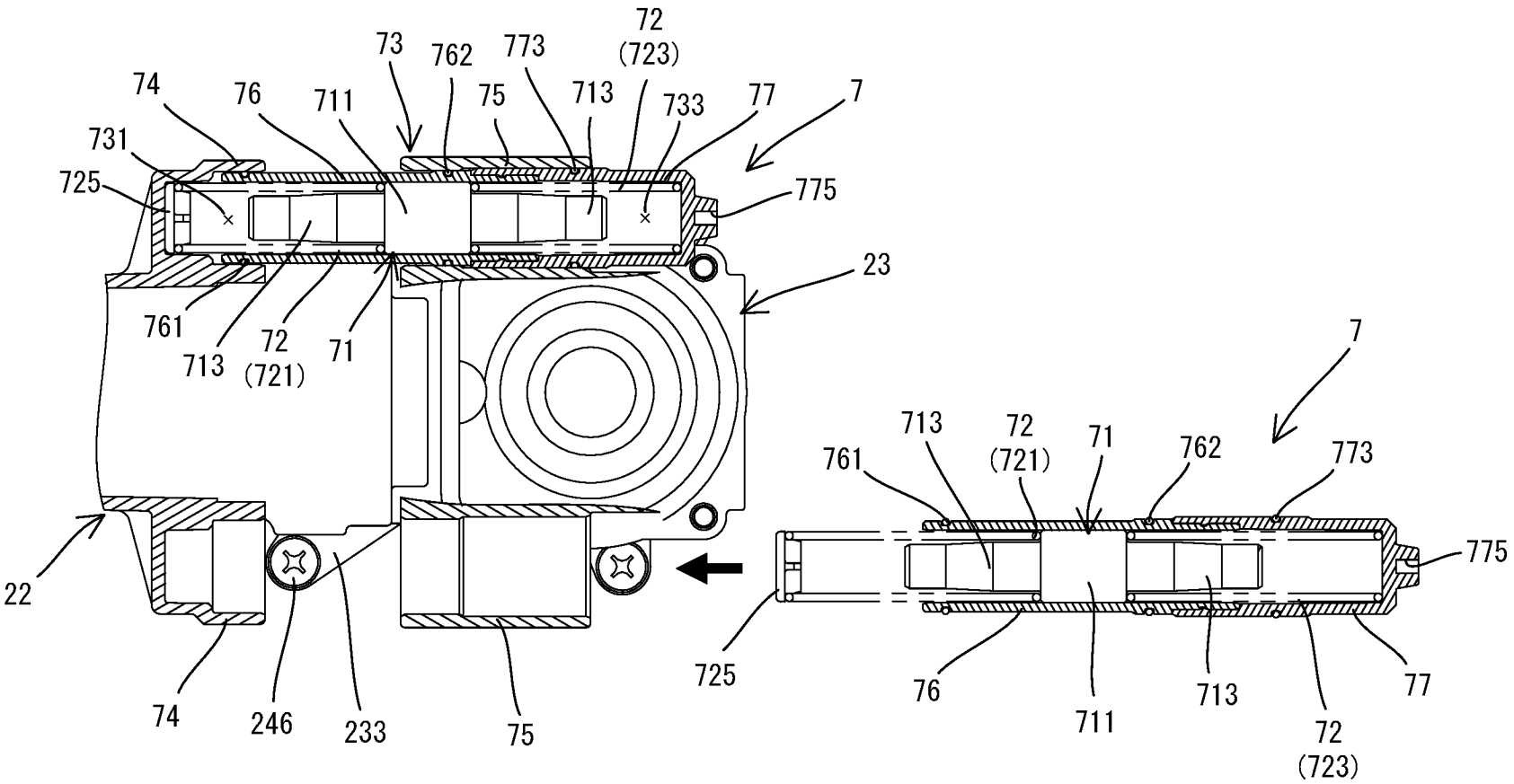
FIG. 13 is an explanatory drawing for illustrating assembling of the dynamic vibration reducers.

As shown in FIG. 13, an assembling worker first fits and connects the cap 77 having the O-ring 773 fitted thereon, onto the sleeve 76 having the O-rings 761 and 762 fitted thereon. Next, the assembling worker inserts the rear spring 723, the weight 71 and the front spring 721 having the spring-receiving member 725 fitted therein into the connected body of the sleeve 76 and the cap 77 in this order. At this time, a front end portion of the front spring 721 including the spring-receiving member 725 protrudes forward from the open front end of the sleeve 76. The assembling worker inserts the connected body of the sleeve 76 and the cap 77, with the weight 71 and the springs 72 housed therein, into the second support part 75 from the rear, and further inserts the front spring 721 and the front end portion of the sleeve 76 into the first support part 74 from the rear. At this time, the assembling worker adjusts the position of the connected body in the circumferential direction such that the projection 771 does not interfere with the stopper pin 772.

Subsequently, the assembling worker pushes in the cap 77 forward while compressing the springs 72 until the projection 771 is located forward of the stopper pin 772. Thereafter, the assembling worker turns the cap 77 in the circumferential direction up to a position where the projection 771 is engageable with the recess of the stopper pin 772. When the assembling worker releases the push of the cap 77, the projection 771 is locked to the stopper pin 772 by the biasing forces of the springs 72 to complete the assembling. A groove 775 which can be engaged with a tip of a flathead screwdriver is formed in a rear end surface of the cap 77. Therefore, the assembling worker can easily perform a series of operations of pushing in and turning the cap 77 by using a flathead screwdriver.

Before the connected body of the sleeve 76 and the cap 77 is inserted into the first support part 74 and the second support part 75, a space exists between the first support part 74 and the second support part 75 in the front-rear direction. Therefore, in the present embodiment, by utilizing this space, the crank housing 23 is fixedly connected to the motor housing 24 arranged thereunder with the screws 246.

More specifically, as shown in FIGS. 4 and 13, a pair of base parts 233 are provided on a lower end portion of the crank housing 23. The base parts 233 respectively protrude to the left and right between the first support part 74 and the second support part 75 in the front-rear direction, and below the first support part 74 and the second support part 75 in the up-down direction. Further, the motor housing 24 has a pair of right and left base parts 245 protruding upward. The base parts 245 are fixed to the base parts 233 with the screws 246 from above the base part 233. In this manner, utilizing the space between the first support part 74 and the second support part 75, the assembling worker can easily connect and fix the crank housing 23 and the motor housing 24 with the screws 246 before assembling the dynamic vibration reducers 7.

As shown in FIG. 13, the crank housing 23 and the motor housing 24 are also fixedly connected together with screws, behind the second support parts 75 (in positions where the caps 77 are disposed), in a similar manner before assembling of the dynamic vibration reducers 7.

The dynamic vibration reducer 7 of the present embodiment is configured as a dynamic vibration reducer of the type (a so-called pneumatic-driving type) in which the weight 71 is actively driven by utilizing pressure fluctuations within the barrel part 22 and the crank housing 23. More specifically, as shown in FIG. 10, the internal space of the housing part 73 is divided by the weight 71 (specifically, the large-diameter part 711) into a front space 731 formed in front of the weight 71 and a rear space 733 formed behind the weight 71.

As shown in FIG. 9, the front space 731 communicates via a passage 741 with the internal space of the barrel part 22 which houses the cylinder 45 (not shown in FIG. 9). One end of the passage 741 on the front space 731 side communicates with the inside of the small-diameter part (see FIG. 10) of the first support part 74. As described above, the sleeve 76 is not disposed in this position. Therefore, the passage 741 is formed as a single through hole extending obliquely upward from the first support part 74 to the barrel part 22.

As shown in FIG. 4, the rear space 733 communicates via a passage 743 with the internal space of the crank housing 23 which houses the crank shaft 41. One end of the passage 743 on the rear space 733 side communicates with the inside of the cap 77. The passage 743 includes a through hole 744 which is formed through a wall of the cap 77 and a through hole 745 which is contiguous from the through hole 744 and formed through walls of the second support part 75 and the crank housing 23 and extends upward. It is noted that the through hole 744 of the cap 77 communicates with the through hole 745 when the cap 77 is positioned in the circumferential direction by the projection 771 and the stopper pin 772, as described above.

During driving of the hammer 1, the pressure of the internal space of the barrel part 22 and the pressure of the internal space of the crank housing 23 fluctuate by driving of the motion-converting mechanism 40 and the striking mechanism 46. These pressure fluctuations have a phase difference of approximately 180 degrees. Specifically, the pressure of the internal space of the crank housing 23 decreases when the pressure of the internal space of the barrel part 22 increases. On the contrary, the pressure of the internal space of the crank housing 23 increases when the pressure of the internal space of the barrel part 22 decreases. Therefore, with the structure in which the front space 731 and the rear space 733 of the dynamic vibration reducer 7 respectively communicate with the internal space of the barrel part 22 and the internal space of the crank housing 23, the weight 71 of the dynamic vibration reducer 7 can be actively driven by utilizing these pressure fluctuations, so that vibration can be effectively absorbed. This pneumatic-driving type itself is known and therefore not described in detail here.

The detailed structure of the second housing 25 and its internal structure are now described.

The upper housing 27 is first described. As shown in FIGS. 1 to 3, a rear portion of the upper housing 27 has a generally rectangular box-like shape having an open lower end and covers the crank housing 23 from above. Further, a front portion of the upper housing 27 is cylindrically formed and covers an outer periphery of the barrel part 22. An auxiliary handle 97 (see FIGS. 1 and 2) may be removably attached onto the outer periphery of this cylindrical portion of the upper housing 27. The structure of the auxiliary handle 97 is well known and therefore not described in detail here.

The grip part 26 and its internal structure are now described. As shown in FIG. 3, the grip part 26 is configured as a cylindrical portion extending in the up-down direction. The trigger 261 is provided in the front portion of the grip part 26 and configured to be depressed (pulled) by a user. A switch 263 is disposed within the grip part 26. The switch 263 is configured to be switched between an ON state and an OFF state according to the operation of the trigger 261. The switch 263 is electrically connected to the controller 30 via a wiring, and configured to output a signal indicating an operation amount of the trigger 261 to the controller 30 while the switch 263 is in the ON state.

The lower housing 28 and its internal structure are now described. As shown in FIGS. 1 to 4, the lower housing 28 has a rectangular box-like shape having a partially open upper end. The lower housing 28 extends forward from a lower end portion of the grip part 26. Most of the lower housing 28 is disposed under the motor housing 24. The lower housing 28 includes a battery-mounting part 29, a battery-protection part 280 and a connection part 285.

As described above, the battery-mounting part 29 is provided on a lower end portion of a generally central portion of the lower housing 28 in the front-rear direction. In the present embodiment, the battery-mounting part 29 is configured such that only one rechargeable battery 93 can be removably mounted thereto. It is noted that the battery 93 which can be removably mounted to the hammer 1 of the present embodiment has a maximum voltage of 40 volts.

The structure of the battery 93 is now briefly described. Further, for convenience of explanation, the up-down direction of the battery 93 is defined with the battery 93 mounted to the hammer 1. As shown in FIGS. 3 and 4, the battery 93 has a generally rectangular parallelepiped shape. The battery 93 has a center of gravity G substantially in its center in all of its length, width and height directions. The battery 93 has a hook 931, a button 933, a terminal (not shown) and a pair of guide grooves 935.

The hook 931 and the terminal are provided on the top of the battery 93. The hook 931 is provided in one end portion of the battery 93 in the length direction (a direction orthogonal to the paper surface of FIG. 3, the left-right direction in FIG. 4). The hook 931 is biased by a spring (not shown) and normally protrudes upward from the top of the battery 93. The button 933 is provided on an upper end portion of a side surface of the battery 93 which defines the width direction of the battery 93. The hook 931 is configured to retract downward from the top of the battery 93 by pressing the button 933 downward. The terminal is provided adjacent to the hook 931 on the top of the battery 93. The pair of the guide grooves 935 are respectively formed in upper end portions of side surfaces of the battery 93 which extend along the length direction. The guide grooves 935 are formed to linearly extend in the length direction of the battery 93.

As shown in FIGS. 1 to 4, the battery-mounting part 29 is configured, corresponding to the battery 94 having the above-described structure, such that the upper end portion of the battery 93 is mounted to the battery-mounting part 29 with a portion of the battery 93 exposed downward therefrom. In the present embodiment, the battery-mounting part 29 is configured to slidably engage with the battery 93 in the left-right direction, with the length direction of the battery 93 aligned with the left-right direction. Specifically, the battery-mounting part 29 has a pair of guide rails 293, a hook-engagement part 291 and a battery-connection terminal (not shown). The guide rails 293 linearly extend in the left-right direction and are configured to slidably engage with the guide grooves 935 of the battery 93. The hook-engagement part 291 is a recess which is recessed upward and configured to engage with the hook 931 of the battery 93. The battery-connection terminal is configured to be electrically connected to the terminal of the battery 93 when the guide grooves 935 are slidably engaged with the guide rails 293 and the hook 931 is engaged with the hook-engagement part 291.

In the present embodiment, the battery 93 may be mounted to the battery-mounting part 29 by being slid rightward from the left of the hammer 1, with the hook 931 on the left side. For this purpose, the hook-engagement part 291 is provided in a left end portion of the battery-mounting part 29. The battery-connection terminal is configured to be connected to the terminal of the battery 93 from the right. The button 933 for disengaging the hook 931 is provided on an upper end portion of a left side of the battery 93. Correspondingly, a recess 287 is provided in a region of the lower housing 28 adjacent to and above the button 933. The recess 287 is configured to allow a user to insert his or her finger therein, so that the user can easily operate the button 933, Further, the battery-mounting part 29 is configured such that the center of gravity G of the battery 93 mounted thereto is located between the rotation axis A2 of the motor shaft 315 and the rotation axis A3 of the crank shaft 41 in the front-rear direction (when viewed from the right or left) (see FIG. 3), and located substantially on the center line of the housing 20 (on the above-described imaginary plane P) in the left-right direction (when viewed from the front or rear) (see FIG. 4).

The battery-protection part 280 and its internal structure are now described.

The battery-protection part 280 is configured to protect the exposed portion of the battery 93 from an external force when the battery 93 is mounted to the battery-mounting part 29. In the present embodiment, the battery-protection part 280 includes a front protection part 281 and a rear protection part 282. The front protection part 281 and the rear protection part 282 are respectively provided on the opposite sides of (on the front side (forward) and on the rear side (rearward) of) the battery-mounting part 29 in the front-rear direction. In the present embodiment, the front protection part 281 and the rear protection part 282 are each formed as a portion of the housing 20 (the lower housing 28). More specifically, the front protection part 281 and the rear protection part 282 are hollow portions of the lower housing 28 which are arranged across the battery-mounting part 29 and protrude downward of the battery-mounting part 29.

As shown in FIGS. 3 and 4, the front protection part 281 and the rear protection part 282 are configured such that their respective lower surfaces are located downward of a lower surface of the battery 93 mounted to the battery-mounting part 29 in the up-down direction. Further, the front protection part 281 and the rear protection part 282 are slightly shorter than the battery 93 in the left-right direction. Therefore, the right and left end portions of the battery 93 mounted to the battery-mounting part 29 slightly protrude from the lower housing 28 in the left-right direction.

In the present embodiment, the upper end portion of the battery 93 is mounted to the battery-mounting part 29, and most of the battery 93 is exposed downward from the battery-mounting part 29. Therefore, the front protection part 281 and the rear protection part 282 are provided to protect the portions of the battery 93 which are exposed from the battery-mounting part 29. Specifically, the front protection part 281 is configured to protect a front-side portion of the battery 93 from an external force. The rear protection part 282 is configured to protect a rear-side portion of the battery 93 from an external force. More specifically, the front protection part 281 is configured to protect the front-side portion by mainly interfering with an external force applied toward the front-side portion from the front (including the diagonal front) of the front protection part 281. The rear protection part 282 is configured to protect the rear-side portion by mainly interfering with an external force applied toward the rear-side portion from the rear (including the diagonal rear) of the rear protection part 282.

The battery 93 having a generally rectangular parallelepiped shape has a lower end portion with four corner regions 930 (two in its right and left front and two in its right and left rear). These four corner regions 930 tend to be subject to external forces when the hammer 1 falls, in particular. Therefore, the front protection part 281 and the rear protection part 282 are configured to effectively protect the corner regions 930 against impact of falling, in particular. Specifically, when assuming an imaginary straight line connecting the center of gravity of the hammer 1 (including the auxiliary handle 97) with the battery 93 mounted to the battery-mounting part 29 and either one of the corner regions 930 of the lower front end portion of the battery 93, and further assuming an imaginary plane orthogonal to this imaginary straight line and passing through the corner region 930, the front protection part 281 is formed to protrude in a direction further away from the center of gravity than this imaginary plane. Similarly, the rear protection part 282 is formed to protrude from an imaginary plane orthogonal to an imaginary straight line, which connects the center of gravity of the hammer 1 and either one of the corner regions 930 of the lower rear end portion of the battery 93, and passing through the corner region 930.

Generally, in a case where the hammer 1 falls with the battery 93 mounted to the hammer 1 and with the center of gravity of the hammer 1 on any one of the corner regions 930 (in other word, in such an attitude that the center of gravity is located just above the corner region 930, or with the whole weight of the hammer 1 applied to the corner region 930) and the corner region 930 collides against the ground or floor, larger impact may act on the corner region 930 and the risk of damage to the battery 93 may be increased. By provision of the front protection part 281 and the rear protection part 282 formed to protrude from the above-described respective imaginary planes, even if the hammer 1 falls with the center of gravity on any one of the corner regions 930, the front protection part 281 or the rear protection part 282 first comes into contact with the ground or floor, thereby effectively protecting the corner region 930.

In the present embodiment, the controller 30 is housed within the rear protection part 282. Although not shown in detail, the controller 30 includes a control circuit 300 for controlling driving of the motor 31, a board on which the control circuit 300 is mounted, and a case for housing them. The controller 30 has a generally rectangular parallelepiped shape as a whole, having a length, a width and a thickness. Further, among the length, the width and the thickness of the controller 30, the length is the largest and the thickness is the smallest. The controller 30 is disposed within the rear protection part 282 such that the directions of the length, the width and the thickness coincide with the left-right direction, the up-down direction and the front-rear direction, respectively. Further, in the present embodiment, the control circuit 300 is configured as a microcomputer including a CPU, a ROM, a RAM and a timer. The controller 30 is electrically connected to the motor 31, the switch 263, the detection unit 6 and the terminal of the battery-mounting part 29 via wirings 301 (only partially shown). The drive control of the motor 31 by the controller 30 will be described later in detail.

The connection part 285 and its internal structure are now described.

As shown in FIGS. 1 to 3, the connection part 285 is a hollow portion which connects a lower end portion of the grip part 26 and the rear protection part 282. The connection part 285 extends forward from the lower end portion of the grip part 26 to the rear protection part 282. A continuous internal space is formed within the grip part 26 and the lower housing 28. An internal space of the grip part 26 is connected to an internal space of the rear protection part 282 via an internal space of the connection part 285. Therefore, in the present embodiment, the internal space of the connection part 285 is effectively utilized as an arrangement space for a wiring (not shown) which electrically connects the switch 263 disposed within the grip part 26 and the controller 30 disposed within the rear protection part 282, and a wiring connector (not shown).

Further, a wireless-communication unit 286 is also housed within the connection part 285. The wireless-communication unit 286 is an electronic device which is configured to enable wireless communication with an external device. In the present embodiment, the wireless-communication unit 286 is configured to wirelessly transmit a specified signal to a stationary dust collector (not shown) which is provided separate from the hammer 1, using a specified frequency band according to a control signal from the controller 30. Such a system itself is known and therefore only briefly described here. The controller 30 controls the wireless-communication unit 286 to transmit the signal while the trigger 261 is depressed and the switch 263 is in the ON state. A controller of the dust collector is configured to drive a motor of the dust collector while the controller receives the signal from the wireless-communication unit 286. Thus, a user of the hammer 1 can cause the dust collector to operate in conjunction with the hammer 1 by only depressing the trigger 261.

As described above, in the present embodiment, the internal space of the connection part 285, which tends to become a free space, is effectively utilized to dispose the wireless-communication unit 286, thereby enhancing convenience of the hammer 1. It is noted that the wireless-communication unit 286 is not limited to the one configured to transmit the specified signal to the dust collector, but may be configured to enable wireless communication with other external devices (such as a mobile terminal), or may be omitted.

The inlets 201 for communicating the inside of the connection part 285 with the outside are formed in right and left side walls of the connection part 285. When the motor 31 is driven, the air flow generated by the fan 33 is led into the connection part 285 through the inlets 201 and flows into the motor housing 24 through the lower housing 28. In the present embodiment, the controller 30 is disposed on a path of this air flow in the vicinity of the inlets 201. Therefore, not only the motor 31 but also the controller 30 can be effectively cooled by the air flow generated by the fan 33.

The drive control of the motor 31 by the controller 30 is now described.

In the present embodiment, the controller 30 (more specifically, the control circuit 300) is configured to perform so-called soft no-load control. The soft no-load control refers to a drive control method in which, while the switch 263 is in the ON state, the rotation speed of the motor 31 is limited to a predetermined relatively low rotation speed (hereinafter referred to as an initial rotation speed) or less in an unloaded state in which no load is applied to the tool accessory 91, while the rotation speed of the motor 31 is allowed to exceed the initial rotation speed in a loaded state. The soft no-load control can reduce wasteful power consumption of the motor 31 in the unloaded state. In the present embodiment, the rotation speed which is set with the speed-change-dial unit 35 is used as a rotation speed which corresponds to the maximum operation amount of the trigger 261 (namely, a maximum rotation speed). The rotation speed of the motor 31 is set based on the maximum rotation speed and the actual operation amount (rate) of the trigger 261.

In the present embodiment, the detection result of the detection unit 6 is used to discriminate between the loaded state and the unloaded state in the soft no-load control. As described above, the Hall sensor 63 of the detection unit 6 is a detector which is configured to detect via the magnet 62 the position of the lever 61, which is moved along with the movement of the second housing 25 relative to the first housing 21, and thereby detect the position of the second housing 25 relative to the first housing 21.

In the unloaded state, the second housing 25 is located in the rearmost position (initial position) by the biasing forces of the elastic members 501 and 505, and the lever 61 is also located in the initial position (see FIGS. 3 and 7). Therefore, the Hall sensor 63 detects the magnet 62, and the detection unit 6 outputs an ON signal. The controller 30 determines that the motor 31 is in the unloaded state when the output from the detection unit 6 is ON. The controller 30 starts driving of the motor 31 when the switch 263 is switched from the OFF state to the ON state. The controller 30 calculates the rotation speed based on the maximum rotation speed and the operation amount of the trigger 261. In a case where the calculated rotation speed is the initial rotation speed or less, the controller 30 sets the calculated rotation speed as the rotation speed of the motor 31. On the other hand, in a case where the calculated rotation speed exceeds the initial rotation speed, the controller 30 sets the initial rotation speed as the rotation speed of the motor 31. When the motor 31 is driven, the driving mechanism 4 is driven and hammering operation is performed.

When a user holds the grip part 26 and presses the tool accessory 91 against the workpiece, the second housing 25 slides relative to the first housing 21 in the upper sliding part 51 and the lower sliding part 52, and moves forward from the initial position while compressing the elastic members 501 and 502. The lever 61 is also turned from the initial position along with the forward relative movement of the second housing 25. When the second housing 25 and the lever 61 reach the respective OFF positions, the Hall sensor 63 stops outputting the ON signal. The controller 30 recognizes the change from ON to OFF of the output from the Hall sensor 63 as a shift from the unloaded state to the loaded state.

After recognizing the shift to the loaded state, the controller 30 drives the motor 31 at a rotation speed which is calculated based on the maximum rotation speed and the operation amount of the trigger 261. At this time, the controller 30 may immediately or gradually increase the rotation speed of the motor 31 up to the calculated rotation speed. Further, in a case where the switch 263 is turned on while the output from the Hall sensor 63 is OFF (that is, in the loaded state), the controller 30 starts driving of the motor 31 at the rotation speed which is calculated based on the maximum rotation speed and the operation amount of the trigger 261.

When the operation of depressing the trigger 261 is released and the switch 263 is turned off, the controller 30 stops driving of the motor 31.

The controller 30 may be configured to limit the rotation speed of the motor 31 to the initial rotation speed or less when recognizing a change from OFF to ON of the output from the Hall sensor 63 (that is, relative movement of the second housing 25 and the lever 61 from the respective OFF positions toward the respective initial positions, or a shift from the loaded state to the unloaded state) while the switch 263 is in the ON state. In this case, for example, the controller 30 may monitor the duration of the ON state of the Hall sensor 63 after the change, by using the timer. Only when the ON state continues for a specified period of time, the controller 30 may limit the rotation speed of the motor 31 to the initial rotation speed or less. Such control can reliably discriminate between a temporary change to the ON state, which may be caused when the first housing 25 is vibrated by the processing operation, and a change from the loaded state to the unloaded state.

Specifically, the second housing 25 reciprocally moves in the front-rear direction relative to the first housing 21 due to the vibration of the first housing 21 in the front-rear direction. Along with this movement, the lever 61 having the magnet 62 also turns. In this case, the output from the Hall sensor 63 may be switched between ON and OFF in a short cycle. On the other hand, in the case of a shift to the unloaded state by release of pressing of the tool accessory 91, after the output from the Hall sensor 63 is switched from OFF to ON, the ON state continues for a certain period of time. Therefore, by employing the above-described control, the controller 30 can more reliably recognize the shift from the loaded state to the unloaded state based on the detection results of the Hall sensor 63.

As described above, the hammer 1 of the present embodiment includes the first housing 21 which houses the motor 31 and the driving mechanism 4 and the second housing 25 which includes the grip part 26 and which is elastically connected to the first housing 21 so as to be movable at least in the front-rear direction relative to the first housing 21. Further, the hammer 1 includes the detection unit 6 which is configured to detect pressing of the tool accessory 91 against a workpiece, and the controller 30 (specifically, the control circuit 300) which is configured to control driving of the motor 31 based on the detection result of the detection unit 6. The detection unit 6 includes the lever 61, which is provided in the first housing 21 and configured to be moved by the relative movement of the second housing 25 in the front-rear direction, and the Hall sensor 63, which is provided in the first housing 21 and which is configured to detect the pressing of the tool accessory 91 by detecting the movement of the lever 61.

When the tool accessory 91 is pressed against a workpiece, the second housing 25, which is elastically connected to the first housing 21, moves in the front-rear direction relative to the second housing 25. Thus, the shift from the unloaded state to the loaded state corresponds to the forward relative movement of the second housing 25. The forward relative movement of the second housing 25 corresponds to the movement of the lever 61. Therefore, by detecting the movement of the lever 61 (specifically, by detecting or not detecting the magnet 62 attached to the second end portion 612 of the lever 61), the Hall sensor 63 can appropriately detect the pressing of the tool accessory 91 against the workpiece (the shift from the unloaded state to the loaded state). The controller 30 then controls driving of the motor 31 according to whether the tool accessory 91 is in the unloaded state or in the loaded state, based on the detection result of the detection unit 6.

In the present embodiment, the lever 61 and the Hall sensor 63 of the detection unit 6 are both disposed in the same first housing 21. In a case where the lever 61 is disposed in one of the first housing 21 and the second housing 25 and the Hall sensor 63 is disposed in the other of the first housing 21 and the second housing 25, the positional relationship between the lever 61 and the Hall sensor 63 may differ from an original setting, due to respective dimensional errors of the first housing 21 and the second housing 25. As a result, the Hall sensor 63 may not be able to accurately detect a shift from the unloaded state to the loaded state. In the present embodiment, however, the positional relationship between the lever 61 and the Hall sensor 63 is more stabilized and the risk of erroneous detection can be reduced since both the lever 61 and the Hall sensor 63 are disposed in the same first housing 21.

In the present embodiment, the detection unit 6 is configured as one assembly including the lever 61 and the Hall sensor 63. Therefore, in the process of assembling the hammer 1, an assembling worker can assemble the detection unit 6, which is previously assembled as a single assembly, to the first housing 21, so that ease of assembling can be enhanced.

The Hall sensor 63 is capable of detecting the movement of the lever 6 in a non-contact manner by detecting the magnet 62 attached to the lever 61. Therefore, the Hall sensor 63 is not worn by contact with an object to be detected, so that degradation of detection accuracy due to wear can be prevented.

In the present embodiment, the lever 61 is adopted as a movable member which is configured to be moved by the relative movement of the second housing 25 in the front-rear direction. The lever 61 has the first end portion 611 and the second end portion 612, and is rotatably supported around the rotation axis A4 located closer to the first end portion 611 than to the second end portion 612. With this structure, compared with a structure using a movable member which is linearly movable, the degree of freedom of an arrangement position of the Hall sensor 63 can be enhanced by appropriately setting the shape and size of the rotary type lever 61 and the position of the rotation axis A4. Further, the movement of the second end portion 612 is made larger than the movement of the first end portion 611 by setting the rotation axis A4 closer to the first end portion 611 which is actuated by the second housing 25, than to the second end portion 612 which is used to detect the movement of the lever 61. Therefore, the magnet 62 can be reliably moved out of the detection range of the Hall sensor 63 by relatively small movement of the second housing 25.

Further, in the present embodiment, the first housing 21 and the second housing 25 are elastically connected to each other so as to be slidable in the front-rear direction. Thus, the movement of the first housing 21 and the second housing 25 relative to each other in the front-rear direction and the corresponding movement of the lever 61 can be more stabilized, so that the pressing of the tool accessory 91 can be more accurately detected. Particularly, in the present embodiment, the first housing 21 and the second housing 25 have two sliding parts (that is, the upper sliding part 51 and the lower sliding part 52) which are arranged apart from each other in the up-down direction. In other words, the first housing 21 and the second housing 25 are slidable with each other in the upper and lower two locations. Further, the detection unit 6 is provided in the vicinity of the upper sliding part 51 which is closer to the driving axis A1 than the lower sliding part 52. In the hammer 1, with the structure in which the tool accessory 91 extends along the driving axis A1, the forward relative movement of the second housing 25 can be more accurately detected in a position closer to the driving axis A1 when the tool accessory 91 is pressed against a workpiece. In the present embodiment, the sliding movement of the first housing 21 and the second housing 25 in the front-rear direction can be further stabilized by the two sliding parts, and the pressing of the tool accessory 91 can be more accurately detected in the vicinity of the upper sliding part 51 closer to the driving axis A1.

In the present embodiment, the controller 30 (the control circuit 300) is configured to drive the motor 31 at a rotation speed which does not exceed a specified rotation speed (the initial rotation speed), in a case where pressing of the tool accessory 91 is not detected by the Hall sensor 63 (while the output of the Hall sensor 63 is ON). The controller 30 (the control circuit 300) is further configured to be allowed to drive the motor 31 at a rotation speed exceeding the initial rotation speed in a case where pressing of the tool accessory 91 is detected by the Hall sensor 63 (when the output of the Hall sensor 63 is changed from ON to OFF). As a result, power saving can be realized in the unloaded state in which the tool accessory 91 is not pressed against the workpiece.

Further, the hammer 1 of the present embodiment includes the first housing 21 which houses the motor 31 and the driving mechanism 4, and the two dynamic vibration reducers 7. The driving mechanism 4 includes a crank mechanism including the crank shaft 41, the piston 43 and the cylinder 45. The first housing 21 includes the motor housing 24 which houses the motor 31, the crank housing 23 which houses the crank shaft 41, and the cylindrical barrel part 22 which is disposed in front of the crank housing 23 and houses the cylinder 45. Each of the dynamic vibration reducers 7 includes the weight 71, the two springs 72 which are arranged in front of and behind the weight 71, and the housing part 73 which houses the weight 71 and the springs 72. Further, the first support part 74 and the second support part 75, which form portions of the housing part 73, are respectively formed by a portion of the barrel part 22 and a portion of the crank housing 23.

Therefore, for example, even in a case where the length of the crank housing 23 in the front-rear direction is not long enough for the dynamic vibration reducer 7, the dynamic vibration reducer 7 can be arranged by utilizing a portion of the barrel part 22 and a portion of the crank housing 23. Thus, the dynamic vibration reducer 7 can be reasonably arranged regardless of the length of the crank housing 23 in the front-rear direction.

In the present embodiment, the housing part 73 of the dynamic vibration reducer 7 includes the cylindrical sleeve 76 which houses at least a portion of the weight 71 and extends in the front-rear direction. The first support part 74 and the second support part 75 are arranged apart from each other in the front-rear direction and supports the sleeve 76.

With such a structure, the length of the housing part 73 in the front-rear direction (a stroke length of the weight 71) can be set, for example, by appropriately changing the distance between the first support part 74 and the second support part 75 and the length of the sleeve 76. Therefore, the degree of freedom in setting the length of the housing part 73 can be enhanced.

In the present embodiment, the sleeve 76 is held by the first housing 21 (specifically, the crank housing 23) by utilizing the biasing forces of the springs 72. Therefore, the sleeve 76 need not be fixed to the first housing 21 with screws or the like, so that an assembling worker can easily assemble and disassemble the housing part 73.

In the present embodiment, the first support part 74 is configured as a spring-receiving part which is configured to receive the forward biasing force of the spring 72 (the front spring 721). More specifically, the first support part 74 has a bottomed cylindrical shape having a closed front end and receives the front end portion of the spring 72 (the front spring 721) while holding the spring 72 inserted therein. With such a structure, the spring 72 can be efficiently arranged without increasing the number of components.

In the present embodiment, the two dynamic vibration reducers 7 are symmetrically arranged relative to the imaginary plane P including the driving axis A1. Therefore, the dynamic vibration reducers 7 can absorb vibration at the opposite sides of the imaginary plane P in a balanced manner.

In the present embodiment, the internal space of the housing part 73 includes the front space 731 formed in front of the weight 71 and the rear space 733 formed behind the weight 71. The first support part 74 has the passage 741 which provides communication between the front space 731 and the internal space of the barrel part 22. The second support part 75 has the passage 743 which provides communication between the rear space 733 and the internal space of the crank housing 23. With such a structure, the weight 71 can be actively driven by utilizing pressure fluctuations in the internal space of the barrel part 22 and the internal space of the crank housing 23. Therefore, the dynamic vibration reducer 7 can absorb vibration more effectively.

The hammer 1 of the present embodiment includes the housing 20 which houses the motor 31 and the driving mechanism 4, and the battery-mounting part 29 which is formed on the housing 20. The battery-mounting part 29 is configured such that one battery 93 having a generally rectangular parallelepiped shape is removably mounted thereto. The driving mechanism 4 includes a crank mechanism including the crank shaft 41. The crank shaft 41 is disposed behind the motor shaft 315 and is rotatable around the rotation axis A3 which is parallel to the rotation axis A2 of the motor shaft 315. The battery-mounting part 29 is disposed below the motor 31. Further, the battery-mounting part 29 is configured such that the battery 93 can be mounted thereto in the left-right direction and such that the center of gravity G of the battery 93 mounted thereto is located between the rotation axis A2 and the rotation axis A3 in the front-rear direction (when viewed from the right or left).

By provision of such a battery-mounting part 29, the housing 20 can be formed compact in the front-rear direction, compared with a case in which a plurality of batteries are mounted side by side in the front-rear direction. Further, in the present embodiment, the battery-mounting part 29 is configured such that the battery 93 is mounted thereto in an orientation in which the longitudinal direction of the battery 93 coincides with the left-right direction of the hammer 1. Therefore, even when compared with a case in which one battery is mounted in an orientation in which the longitudinal direction of the battery coincides with the front-rear direction, the housing 20 can be formed compact in the front-rear direction. Further, the battery-mounting part 29 is configured such that the center of gravity of the battery 93 mounted to the battery-mounting part 29 is located in the vicinity of the center of gravity of each of the relatively heavy motor 31 and crank shaft 41. By such concentrated arrangement of the centers of gravity, that is, by preventing the center of gravity of the battery 93 from being located away from the center of gravity of the hammer 1, the hammer 1 can be provided with excellent workability.

In the present embodiment, the hammer 1 includes the front protection part 281 and the rear protection part 282 which are provided in front of and behind the battery-mounting part 29, respectively, in the front-rear direction. The front protection part 281 and the rear protection parts 281 are configured to respectively protect the front and rear-side portions of the battery 93 from an external force. The exposed portion of the battery 93 mounted to the battery-mounting part 29 is susceptible to damage when subjected to an external force. The provision of the front protection part 281 and the rear protection parts 281, however, can reduce the risk of damage to the battery 93. Further, in the present embodiment, the front protection part 281 and the rear protection part 282 are configured to protect the corner regions 930 of the lower front end portion and the lower rear end portion of the battery 93, respectively, from external forces. Therefore, the risk of damage to the corner regions 930, particularly due to impact upon falling of the hammer 1, can also be effectively reduced. Further, the front protection part 281 and the rear protection part 282 are each formed by a portion of the housing 20. Therefore, the hammer 1 is provided with an additional function of protecting the battery 93 without increasing the number of components.

In the present embodiment, the controller 30, including the control circuit 300 which is configured to control driving of the motor 31, is disposed within the rear protection part 282. Further, the controller 30 has a generally rectangular parallelepiped shape having a length, a width and a thickness. Among the length, the width and the thickness, the length is the largest and the thickness is the smallest. The controller 30 is arranged in an orientation in which the thickness direction and the length direction coincide with the front-rear direction and the left-right direction, respectively. In this manner, the controller 30 can be reasonably arranged within the rear protection part 282, while avoiding increase of the length of the rear protection part 282 in the front-rear direction and the up-down direction, by effectively utilizing the internal space of the rear protection part 282, which tends to become a free space.

Further, the hammer 1 is configured to be held by a user, and has the cylindrical grip part 26 extending in the up-down direction and the hollow connection part 285 which connects the lower end portion of the grip part 26 and the rear end portion of the rear protection part 282. Therefore, the internal space of the connection part 285, which tends to become a free space, can be effectively utilized, for example, as an arrangement space for various components, wirings and connectors.

Correspondences between the features of the above-described embodiment and the features of the invention are as follows. However, the features of the above-described embodiment are mere examples and thus do not limit the features of the invention. The electric hammer 1 is an example of the "impact tool". The tool accessory 91 is an example of the "tool accessory". The motor 31 is an example of the "motor". The driving mechanism 4 is an example of the "driving mechanism". The driving axis A1 is an example of the "driving axis". The first housing 21 is an example of the "tool body". The second housing 25 and the grip part 26 are examples of the "elastically-connected part" and the "grip part", respectively. The detection unit 6 is an example of the "detecting mechanism". The controller 30 (more specifically, the control circuit 300) is an example of the "control part". The lever 61 (more specifically, the lever arm 610) and the Hall sensor 63 are examples of the "movable member" and the "detector", respectively. The Hall sensor 63 and a magnet 62 are examples of the "Hall sensor" and the "magnet", respectively. The motor shaft 315 is an example of the "motor shaft". The barrel part 22 and the crank housing 23 are an example of the "driving-mechanism-housing part". The motor housing 24 is an example of the "motor-housing part". The upper housing 27 and the lower housing 28 are examples the "upper-extending part" and the "lower-extending part", respectively. The upper sliding part 51 and the lower sliding part 52 are examples of the "upper sliding part" and the "lower sliding part", respectively. The first end portion 611, the second end portion 612 and the rotation axis A4 of the lever arm 610 are examples of the "first end portion", the "second end portion" and the "rotation axis", respectively. The torsion coil spring 67 is an example of the "biasing member". The initial rotation speed is an example of the "specified rotation speed".

The above-described embodiment is a mere example and an impact tool according to the present invention is not limited to the structure of the hammer 1 of the above-described embodiment. For example, the following modifications may be made. Further, any one or more of these modifications may be adopted in combination with the hammer 1 of the above-described embodiment or the claimed invention.

In the above-described embodiment, the hammer 1 which is configured to perform only a hammering operation of linearly driving the tool accessory 91 is described as an example of the impact tool. However, the present invention may be embodied as another impact tool which is capable of performing an operation other than the hammering operation. For example, the impact tool may be a hammer drill which is capable of performing a drilling operation, in addition to the hammering operation. The drilling operation refers to an operation of rotationally driving the tool accessory 91 around the driving axis A1.

The structures and arrangement relations of the motor 31, the driving mechanism 4, the first housing 21 (the tool body) which houses the motor 31 and the driving mechanism 4, and the second housing 25 (the elastically-connected part) having the grip part 26 may be appropriately changed, depending on the impact tool. Examples of adoptable modifications are as follows.

The motor 31 may be a motor with a brush and not a brushless motor. Further, the motor 31 may be an AC motor. In this case, a power cable for connection to an external commercial power source may be provided to the housing 20, in place of the battery-mounting part 29, and the battery-protection part 280 may be omitted. Further, as the motion-converting mechanism 40 of the driving mechanism 4, a known motion-converting mechanism using a swinging member may be adopted, in place of the crank mechanism of the above-described embodiment.

The shapes of the first housing 21 and the second housing 25 may be appropriately changed. For example, in the above-described embodiment, the second housing 25, which is elastically connected to the first housing 21, is configured to partially cover the first housing 21. A region of the first housing 21 which is covered by the second housing 25 and its range are not limited to those of the above-described embodiment. The arrangement positions, kinds and numbers of the elastic members 501 and 505 which are disposed between the first housing 21 and the second housing 25 can be optionally selected. Further, as the elastic members 501 and 505, various other kinds of spring, rubber or elastic synthetic resin may be adopted, in place of the compression coil spring.

A handle including a grip part may be elastically connected to the first housing 21 which houses the motor 31 and the driving mechanism 4. In this case, upper and lower end portions of the handle may be connected to the first housing 21 via one or more elastic members. Alternatively, only the upper end portion of the handle may be elastically connected to the first housing 21 in a cantilever manner. Further, the upper end portion of the handle may be elastically connected to the first housing 21 so as to be movable in the front-rear direction relative to the first housing 21, while the lower end portion of the handle may be supported by the first housing 21 so as to be rotatable around a rotation axis extending in the left-right direction. The elastic members disposed between the first housing 21 and the handle may be changed, like the elastic members 501 and 505.

Portions (sliding parts) of the first housing 21 and the second housing 25 which slide in the front-rear direction relative to each other are not limited to the upper sliding parts 51 and the lower sliding part 52. For example, only one sliding part may be provided in the up-down direction. Further, a plurality of sliding parts may be provided in positions different from those of the above-described embodiment. Alternatively, the sliding parts may be omitted.

The battery-mounting part 29 may be configured such that a plurality of batteries 93 can be removably mounted thereto. In this case, the position of the battery-mounting part 29 and the structure of the battery-protection part 280 may be appropriately changed. Further, the battery-protection part 280 may be omitted.

The structure and arrangement position of the detection unit 6 for detecting pressing of the tool accessor 91 against a workpiece are not limited to those of the above-described embodiment. Specifically, the detection unit 6 may be appropriately changed, insofar as the detection unit 6 includes the movable member which is provided in one of the first housing 21 and the second housing 25 and configured to be moved by relative movement of the other housing in the front-rear direction, and the detector which is provided in the one same housing as the movable member and configured to detect pressing of the tool accessor 91 against a workpiece by detecting the movement of the movable member.

For example, a movable member which is linearly movable may be adopted, in place of the rotary type lever 61. In this case, for example, the movable member may be provided in one of the first housing 21 and the second housing 25 and configured to be moved in the front-rear direction in contact with the other housing (or a separate member integrated with the other housing). The movable member may be formed by a combination of a plurality of members (for example, a rotatable member and a linearly movable member). The movable member may be mounted, for example, to the rear-wall part 231 of the crank housing 23 in the first housing 21 and configured to be actuated by the upper housing 27. Alternatively, the movable member may be mounted to the lower end portion of the motor housing 24 and configured to be actuated by the lower housing 28. The movable member may be mounted not to the first housing 21 but to the second housing 25 and configured to be move along with movement of the first housing 21 in the front-rear direction relative to the second housing 25. The lever 61 of the above-described embodiment may be biased by other kinds of spring, rubber or elastic synthetic resin, in place of the torsion coil spring 67.

The detection system of the detector is not particularly limited, and an optical sensor or a contact type mechanical switch may be adopted in place of the magnetic-field detection type Hall sensor 63. It is noted that the detector needs to be mounted to the same one of the first housing 21 and the second housing 25 as the movable member, but the mounting position of the detector in the housing may be appropriately changed, according to the structure of the movable member and the detection system.

In the above-described embodiment, the detection unit 6 is configured as one assembly including the lever 61 and the Hall sensor 63. However, the lever 61 and the Hall sensor 63 may be respectively supported by separate holders and mounted to the first housing 21 or the second housing 25.

In the above-described embodiment, the hammer 1 has a pair of the right and left dynamic vibration reducers 7. However, the structure, arrangement position and number of the dynamic vibration reducers 7 may be appropriately changed, or the dynamic vibration reducers 7 may be omitted.

In the above-described embodiment, the controller 30 (the control circuit 300) is configured to perform soft no-load control based on the detection result of the detection unit 6. The controller 30 (the control circuit 300) may, however, be configured so as not to drive the motor 31 while pressing of the tool accessory 91 is not detected by the Hall sensor 63, but to start driving of the motor 31 in response to detection of pressing of the tool accessory 91 by the Hall sensor 63. In this case, further power saving can be realized in the unloaded state. Further, the drive control processing of the motor 31 may be performed not by the control circuit 300 formed by a microcomputer, but by a control circuit of other types, for example, a programmable logic device such as ASIC (application specific integrated circuits) and an FPGA (field programmable gate array). The drive control processing of the motor 31 may be distributed by a plurality of control circuits.

The following aspects 1 to 15 are provided with the aim to provide a technique related to rationalization of arrangement of a dynamic vibration reducer in an impact tool. Each of the following aspects 1 to 15 may be adopted individually or in combination with any one or more of the other aspects. Alternatively, at least one of the following aspects 1 to 15 may be adopted in combination with any of the hammer 1 of the above-described embodiment, the above-described modifications and the claimed invention.

Aspect 1

An impact tool, comprising:

a motor, a driving mechanism configured to linearly drive a tool accessory along a driving axis by power of the motor, the driving axis defining a front-rear direction of the impact tool;

a housing that houses the motor and the driving mechanism; and at least one dynamic vibration reducer each including a weight, at least one spring and a housing part, the weight being linearly movable in the front-rear direction, the at least one spring being disposed at least either in front of or behind the weight, the weight and the at least one spring being housed in the housing part, wherein:

the driving mechanism includes:

a crank shaft configured to rotate by power of the motor;

a cylinder extending along the driving axis in the front-rear direction; and a piston configured to reciprocate along the driving axis within the cylinder along with rotation of the crank shaft, the housing includes:

a motor housing that houses the motor;

a crank housing that houses the crank shaft, and a barrel part that is arranged in front of the crank housing and houses the cylinder, and a portion of the barrel part and a portion of the crank housing respectively form a first part and a second part, each of the first part and the second part being a portion of the housing part of the at least one dynamic vibration reducer.

In the impact tool of the present aspect, the housing part of the dynamic vibration reducer, which houses the weight and the at least one spring, is partially formed by a portion of the crank housing and a portion of the barrel part arranged in front of the crank housing. Therefore, the dynamic vibration reducer can be reasonably arranged without being constrained by the length of the crank housing in the front-rear direction.

Aspect 2

The impact tool as defined in aspect 1, wherein:

the housing part includes a cylindrical member that houses at least a portion of the weight, the cylindrical member extending in the front-rear direction, and the first part and the second part are arranged apart from each other in the front-rear direction and support the cylindrical member.

According to the present aspect, the degree of freedom in setting the length of the housing part in the front-rear direction (a stroke length of the weight) can be enhanced.

Aspect 3

The impact tool as defined in aspect 2, wherein:

the motor includes a motor shaft, the motor shaft being rotatable around a rotation axis orthogonal to the driving axis and defining an up-down direction of the impact tool, the motor housing is arranged on a lower side of the crank housing, and the crank housing and the motor housing are fixedly connected to each other with screws, between the first part and the second part in the front-rear direction.

According to the present aspect, an assembling worker who assembles the impact tool can easily connect and fix the crank housing to the motor housing by utilizing a space between the first part and the second part, before assembling the cylindrical member to the first part and the second part.

Aspect 4

The impact tool as defined in aspect 2 or 3, wherein the cylindrical member is held by the housing by utilizing a biasing force of the at least one spring.

According to the present aspect, the cylindrical member need not be fixed to the housing with a screw or the like, so that assembling worker can easily assemble and disassemble the housing part.

Aspect 5

The impact tool as defined in any one of aspects 1 to 4, wherein either one of the first part and the second part is configured as a spring-receiving part configured to receive a biasing force of the at least one spring.

According to the present aspect, the first part which is a portion of the barrel part or the second part which is a portion of the crank housing can be utilized as the spring-receiving part, so that the spring can be efficiently arranged without increasing the number of components.

Aspect 6

The impact tool as defined in any one of aspects 1 to 5, wherein the at least one dynamic vibration reducer includes two dynamic vibration reducers which are symmetrically arranged relative to an imaginary plane including the driving axis.

According to the present aspect, the two dynamic vibration reducers can absorb vibration in a balanced manner at the opposite sides of the imaginary plane including the driving axis.

Aspect 7

The impact tool as defined in any one of aspects 1 to 6, wherein:

an internal space of the housing part includes a first space formed in front of the weight and a second space formed behind the weight, the first part has a first air passage providing communication between an internal space of the barrel part and the first space, and the second part has a second air passage providing communication between an internal space of the crank housing and the second space.

According to the present aspect, the weight can be actively driven by utilizing pressure fluctuations in the internal space of the barrel part and the internal space of the crank housing, so that vibration can be more effectively absorbed.

Aspect 8

The crank housing and the barrel part are formed separately and fixedly connected to each other.

Aspect 9

The at least one spring includes a first spring disposed in front of the weight and a second spring disposed behind the weight.

Aspect 10

Each of the first part and the second part is configured as a cylindrical part having an axis extending in the front-rear direction.

Aspect 11

In aspect 10, one of the first part and the second par configured as the spring-receiving part has a bottomed cylindrical shape.

Aspect 12

In aspect 11, the other of the first part and the second part has a cylindrical shape, and the cylindrical member is inserted and supported through the other of the first part and the second part.

Aspect 13

A front end portion or a rear end portion of the cylindrical member is biased by the at least one spring and held in abutment with a stopper part provided in the housing.

Aspect 14

The cylindrical member includes:

a cylindrical sleeve having an open front end and an open rear end; and a cap which closes the front end or the rear end of the sleeve.

Aspect 15

The impact tool is a hammer configured to only linearly drive the tool accessory along the driving axis.

Correspondences between the features of the above-described embodiment and the features of aspects 1 to 15 are as follows. The electric hammer 1 is an example of the "impact tool". The motor 31 is an example of the "motor". The driving mechanism 4 is an example of the "driving mechanism". The tool accessory 91 is an example of the "tool accessory". The driving axis A1 is an example of the "driving axis". The first housing 21 is an example of the "housing". The dynamic vibration reducer 7, the weight 71, the spring 72 and the housing part 73 are examples of the "dynamic vibration reducer", the "weight", the "spring" and the "housing part", respectively. The crank shaft 41, the cylinder 45 and the piston 43 are examples of the "crank shaft", the "cylinder" and the "piston", respectively. The motor housing 24, the crank housing 23 and the barrel part 22 are examples of the "motor housing", the "crank housing" and the "barrel part", respectively. The first support part 74 and the second support part 75 are examples of the "first part" and the "second part", respectively. The connected body of the sleeve 76 and the cap 77 is an example of the "cylindrical member". The motor shaft 315 and the rotation axis A2 are examples of the "motor shaft" and the "rotation axis", respectively. The screw 246 is an example of the "screw". The front space 731 and the rear space 733 are examples of the "first space" and the "second space", respectively. The passages 741 and 743 are examples of the "first air passage" and the "second air passage", respectively. The front spring 721 and the rear spring 723 are examples of the "first spring" and the "second spring", respectively. The stopper pin 722 is an example of the "stopper part". The sleeve 76 and the cap 77 are examples of the "sleeve" and the "cap", respectively.

The impact tool as defined in aspects 1 to 15 is not limited to the structure of the hammer 1 of the above-described embodiment. For example, the following modifications may be made. Further, at least one of these modifications may be adopted in combination with any of the hammer 1 of the above-described embodiment, the modifications to the hammer 1 and the impact tool as defined in aspects 1 to 15.

In the above-described embodiment, the hammer 1 which is configured to perform only a hammering operation of linearly driving the tool accessory 91 is described as an example of the impact tool. However, the impact tool defined in aspects 1 to 15 may be embodied as another impact tool which is capable of performing any other operation. For example, the impact tool may be a hammer drill which is capable of performing a drilling operation, in addition to the hammering operation. The drilling operation refers to the operation of rotationally driving the tool accessory 91 around the driving axis A1.

The structures and arrangement relations of the motor 31, the driving mechanism 4, the first housing 21 which houses the motor 31 and the driving mechanism 4, and the second housing 25 may be appropriately changed, depending on the impact tool. Examples of adoptable modifications thereof are as follows.

The motor 31 may be a motor with a brush and not a brushless motor. Further, the motor 31 may be an AC motor. In this case, a power cable for connection to an external commercial power source is provided to the housing 20, in place of the battery-mounting part 29, and the battery-protection part 280 is omitted.

The shapes of the first housing 21 and the second housing 25 may be appropriately changed. For example, in the above-described embodiment, the second housing 25, which is elastically connected to the first housing 21, is configured to partially cover the first housing 21. A region of the first housing 21 which is covered by the second housing 25 and its range are not limited to those of the above-described embodiment. The arrangement positions, kinds, numbers of the elastic members 501 and 505 which are disposed between the first housing 21 and the second housing 25 can be optionally selected. Further, as the elastic members 501 and 505, various other kinds of spring, rubber and elastic synthetic resin may be adopted, in place of the compression coil spring.

A handle including the grip part 26 may be elastically connected to the first housing 21. In this case, each of upper and lower end portions of the handle may be connected to the first housing 21 via one or more elastic members. Alternatively, only the upper end portion of the handle may be elastically connected to the first housing 21 in a cantilever manner. Further, the upper end portion of the handle may be elastically connected to the first housing 21 so as to be movable in the front-rear direction relative to the first housing 21, while the lower end portion of the handle may be supported by the first housing 21 so as to be rotatable around a rotation axis extending in the left-right direction. The elastic members disposed between the first housing 21 and the handle may be changed like the elastic members 501 and 505. Further, the second housing 25 or the handle need not be elastically connected to the first housing 21.

Portions (sliding parts) of the first housing 21 and the second housing 25 which are slidable in the front-rear direction relative to each other are not limited to the upper sliding part 51 and the lower sliding part 52. For example, only one sliding part may be provided in the up-down direction. Further, a plurality of sliding parts may be provided in positions different from those of the above-described embodiment, or the sliding part may be omitted.

The battery-mounting part 29 may be configured such that a plurality of batteries 93 are removably mounted thereto. In this case, the position of the battery-mounting part 29 and the structure of the battery-protection part 280 may be appropriately changed. Further, the battery-protection part 280 may be omitted.

In the above-described embodiment, in order to perform soft no-load control of the motor 31, the detection unit 6 is provided which detects pressing of the tool accessory 91 against a workpiece by detecting movement of the lever 61. In place of the detection unit 6 a detecting mechanism (such as an acceleration sensor) which is configured to detect pressing of the tool accessory 91 by any other method may be adopted. Further, the drive control may be performed so as not to drive the motor 31 while pressing of the tool accessory 91 is not detected, but to start driving of the motor 31 in response to detection of pressing of the tool accessory 91. Alternatively, the detection unit 6 or other detecting mechanism may be omitted. In other words, it is not necessary to control driving of the motor 31 according to whether the tool accessory 91 is pressed or not.

The structure, arrangement position and number of the dynamic vibration reducers 7 may be appropriately changed. Examples of adoptable modifications to the dynamic vibration reducers 7 are as follows.

Only one dynamic vibration reducer 7 may be provided. In this case, for example, the dynamic vibration reducer 7 can be provided on the upper side of the barrel part 22 and the crank housing 23.

In the above-described embodiment, the two springs 72 are arranged on opposite sides of the weight 71, but the dynamic vibration reducer 7 may have only one spring 72. For example, one end of the one spring 72 may be fixed to the housing part 73 and the other end may be fixed to the weight 71. Further, the kind of the spring 72 is not limited to the compression coil spring, but, for example, a tensile coil spring may be adopted.

The sleeve 76 and the cap 77 of the housing part 73 may be configured as a single member or the sleeve 76 and the cap 77 may be omitted. In a case where these members are omitted, the first support part 74 and the second support part 75 may be configured to abut on or engage with each other when the barrel part 22 and the crank housing 23 are connected to each other in the front-rear direction. Further, in place of the first support part 74, the second support part 75 may be configured as a spring-receiving part having a bottomed cylindrical shape. Alternatively, both the first support part 74 and the second support part 75 may have a bottomed cylindrical shape.

In the above-described embodiment, the connected body of the sleeve 76 and the cap 77 is locked with the stopper pin 772 by utilizing the biasing forces of the springs 72 and held by the first housing 21. However, the cap 77 may be fixed to the first housing 21 with a screw or the like.

In the above-described embodiment, the dynamic vibration reducer 7 is configured as a pneumatic-driving type dynamic vibration reducer, and the weight 71 is actively driven by utilizing pressure fluctuations within the barrel part 22 and the crank housing 23. However, the dynamic vibration reducer 7 may be a normal dynamic vibration reducer in which the weight 71 is not actively driven.

Further, the following aspects 16 to 32 are provided with the aim to provide a reciprocating tool which is configured to be powered by a removable battery and which has excellent workability. Each of the following aspects 16 to 32 may be adopted individually or in combination with any one or more of the other aspects. Alternatively, at least one of the following aspects 16 to 32 may be adopted in combination with any of the hammer 1 of the above-described embodiment, the above-described modifications, the above-described aspects, and the claimed invention.

Aspect 16

A reciprocating tool, comprising:

a motor having a motor shaft, the motor shaft being rotatable around a first rotation axis, a driving mechanism including a crank shaft configured to rotate around a second rotation axis along with rotation of the motor shaft, the second rotation axis extending parallel to the first rotation axis, the driving mechanism being configured to drive a tool accessory to linearly reciprocate along a driving axis orthogonal to the second rotation axis;

a housing that houses the motor and the driving mechanism; and a battery-mounting part provided to the housing and configured such that one battery having a generally rectangular parallelepiped shape is removably mounted thereto, wherein:

an extending direction of the first rotation axis, an extending direction of the driving axis and a direction orthogonal to the first rotation axis and the driving axis define an up-down direction, a front-rear direction and a left-right direction of the reciprocating tool, respectively, the crank shaft is disposed behind the motor shaft, the battery-mounting part is disposed below the motor, and the battery-mounting part is configured such that the battery is mounted thereto in the left-right direction and such that the center of gravity of the battery mounted thereto is located between the first rotation axis and the second rotation axis in the front-rear direction.

In the reciprocating tool of the present aspect, only one battery can be mounted to the battery-mounting part below the motor. Therefore, the housing can be made compact in the front-rear direction, compared with a battery-mounting part to which a plurality of batteries can be mounted side by side in the front-rear direction. Further, the battery-mounting part is configured such that the center of gravity of the battery mounted to the battery-mounting part is located between the first rotation axis of the motor shaft and the second rotation axis of the crank shaft in the front-rear direction (when viewed from the right or left). In other words, the battery-mounting part is configured such that the center of gravity of the battery is located in the vicinity of the center of gravity of each of the relatively heavy motor and crank shaft. By such concentrated arrangement of the centers of gravity, that is, by preventing the center of gravity of the battery from being located away from the center of gravity of the reciprocating tool, the reciprocating tool can be provided with excellent workability. The term "reciprocating tool" used in the present aspect refers to a work tool in general which is configured to linearly reciprocate a tool accessory by power of the motor. Examples of such a work tool may include a hammer drill, an electric hammer and a reciprocating saw.

Aspect 17

The reciprocating tool as defined in aspect 16, further comprising:

a front protection part provided forward of the battery-mounting part in the front-rear direction and configured to protect a front-side portion of the battery from an external force when the battery is mounted to the battery-mounting part, and a rear protection part provided rearward of the battery-mounting part in the front-rear direction and configured to protect a rear-side portion of the battery from an external force when the battery is mounted to the battery-mounting part.

Portions of the battery which are exposed from the battery-mounting part when the battery is mounted to the battery-mounting part may be damaged when an external force is applied. According to the present aspect, however, the front protection part and the rear protection part can respectively protect the front-side portion and the rear-side portion of the battery from the external force, thereby reducing the risk of damage to the battery. It is noted that each of the front and rear protection parts may be a portion of the housing, or may be formed as a separate member from the housing and connected to the housing.

Aspect 18

The reciprocating tool as defined in aspect 17, further comprising a controller disposed within the rear protection part, the controller including a control circuit configured to control driving of the motor.

According to the present aspect, the controller can be reasonably arranged by effectively utilizing an internal space of the rear protection part which tends to become a free space.

Aspect 19

The reciprocating tool as defined in aspect 18, wherein:

the controller has a generally rectangular parallelepiped shape having a length, a width and a thickness, among which the length is the largest and the thickness is the smallest, and the controller is arranged in an orientation in which a direction of the thickness and a direction of the length respectively coincide with the front-rear direction and the left-right direction of the reciprocating tool.

According to the present aspect, the controller can be reasonably arranged within the rear protection part, while avoiding increase of the length of the rear protection part in the front-rear direction and the up-down direction.

Aspect 20

The reciprocating tool as defined in any one of aspects 17 to 19, further comprising:

a cylindrical grip part configured to be held by a user and extending in the up-down direction; and a hollow connection part connecting a lower end portion of the grip part and a rear end portion of the rear protection part.

According to the present aspect, an internal space of the connection part which tends to become a free space can be effectively utilized as an arrangement space for various components, wirings or connectors.

Aspect 21

The reciprocating tool as defined in aspect 20, wherein the connection part has inlets configured to allow outside air to flow into the internal space.

According to the present aspect, components or the like disposed in the internal space of the connection part can be cooled by the outside air taken in through the inlets.

Aspect 22

The reciprocating tool as defined in aspect 20 or 21, further comprising a wireless-communication unit disposed within the connection part and configured to wirelessly communicate with an external device.

According to the present aspect, the internal space of the connection part which tends to become a free space can be effectively utilized to provide the reciprocating tool with an additional wireless communication function, thereby enhancing convenience.

Aspect 23

The reciprocating tool as defined in any one of aspects 16 to 22, wherein:

a recess is provided in a region of the housing which is located adjacent to a disengagement button provided on the battery when the battery is mounted to the battery-mounting part, the recess being configured to allow a user's finger to be inserted therein.

According to the present aspect, a user can easily operate the disengagement button.

Aspect 24

The reciprocating tool as defined in any one of aspects 16 to 23, further comprising a battery that is removably mounted to the battery-mounting part.

Aspect 25

The housing includes:

a first housing that houses the motor and the driving mechanism, and a second housing that includes a grip part extending in the up-down direction and configured to be held by a user, the second housing being elastically connected to the first housing so as to be movable at least in the front-rear direction relative to the first housing, and the battery-mounting part is provided to the second housing.

Aspect 26

The second housing includes:

an upper part extending forward from an upper end portion of the grip part and partially covering the first housing; and a lower part extending forward from a lower end portion of the grip part and being at least partially disposed below the motor, and the battery-mounting part is provided to the lower part.

Aspect 27

The first housing includes:

a driving-mechanism-housing part that houses the driving mechanism; and a motor-housing part disposed under the driving-mechanism-housing part and houses the motor, and the battery-mounting part is arranged within a range defined by a front end and a rear end of the motor-housing part in the front-rear direction.

Aspect 28

Each of the front protection part and the rear protection part is formed by a portion of the housing.

Aspect 29

Each of the front protection part and the rear protection part is configured as a protruding part protruding downward of the battery-mounting part.

Aspect 30

The front protection part and the rear protection part are configured to protrude downward of a lower end of the battery mounted to the battery-mounting part.

Aspect 31

The battery-mounting part is configured such that the battery is mounted thereto in an orientation in which a longitudinal direction of the battery coincides with the left-right direction of the reciprocating tool.

Aspect 32

The front protection part and the rear protection part are configured to respectively protect at least one corner region of a lower front end portion of the battery and at least one corner region of a lower rear end portion of the battery from an external force.

Correspondences between the features of the above-described embodiment and the features of aspects 16 to 32 are as follows. The electric hammer 1 is an example of the "reciprocating tool". The motor 31, the motor shaft 315 and the rotation axis A2 are examples of the "motor", the "motor shaft" and the "first rotation axis", respectively. The driving mechanism 4, the crank shaft 41 and the rotation axis A3 are examples of the "driving mechanism", the "crank shaft" and the "second rotation axis", respectively. The tool accessory 91 is an example of the "tool accessory". The driving axis A1 is an example of the "driving axis". The housing 20 is an example of the "housing". The battery-mounting part 29 and the battery 93 are examples of the "battery-mounting part" and the "battery", respectively. The front protection part 281 and the rear protection part 282 are examples of the "front protection part" and the "rear protection part", respectively. The controller 30 and the control circuit 300 are examples of the "controller" and the "control circuit", respectively. The grip part 26 and the connection part 285 are examples of the "grip part" and the "connection part", respectively. The inlet 201 is an example of the "inlet". The wireless-communication unit 286 is an example of the "wireless-communication unit". The button 933 is an example of the "disengagement button". The first housing 21 and the second housing 25 are examples of the "first housing" and the "second housing", respectively. The barrel part 22 and the crank housing 23 are an example of the "driving-mechanism-housing part". The motor housing 24 is an example of the "motor-housing part". The corner region 930 is an example of the "corner region".

The reciprocating tool as defined in aspects 16 to 32 is not limited to the structure of the hammer 1 of the above-described embodiment. For example, the following modifications may be made. Further, at least one of these modifications may be adopted in combination with any of the hammer 1 of the above-described embodiment, the modifications to the hammer 1 and the reciprocating tool as defined in aspects 16 to 32.

In the above-described embodiment, as an example of the reciprocating tool, the hammer 1 is described which is an impact tool and is configured to perform only a hammering operation of linearly driving the tool accessory 91. However, the reciprocating tool as defined in aspects 16 to 32 may be embodied as another work tool configured to linearly reciprocate the tool accessory by power of the motor. For example, the reciprocating tool may be embodied as a hammer drill which is capable of performing a drilling operation of rotationally driving the tool accessory 91 around the driving axis A1, in addition to the hammering operation, or may be embodied as a reciprocating saw.

The structures and arrangement relations of the motor 31, the driving mechanism 4, the first housing 21 which houses the motor 31 and the driving mechanism 4, and the second housing 25 may be appropriately changed, depending on the reciprocating tool. Examples of adoptable modifications are as follows.

For example, the motor 31 may be a motor with a brush and not a brushless motor.

The shapes of the first housing 21 and the second housing 25 may be appropriately changed. For example, in the above-described embodiment, the second housing 25, which is elastically connected to the first housing 21, is configured to partially cover the first housing 21. A region of the first housing 21 which is covered by the second housing 25 and its range are not limited to those of the above-described embodiment. The arrangement positions, kinds and numbers of the elastic members 501 and 505 which are disposed between the first housing 21 and the second housing 25 can be optionally selected. Further, as the elastic members 501 and 505, various other kinds of spring, rubber and elastic synthetic resin may be adopted, in place of the compression coil spring.

A handle including the grip part 26 may be elastically connected to the first housing 21. In this case, each of upper and lower end portions of the handle may be connected to the first housing 21 via one or more elastic members. Alternatively, only the upper end portion of the handle may be elastically connected to the first housing 21 in a cantilever manner. Further, the upper end portion of the handle may be elastically connected to the first housing 21 so as to be movable in the front-rear direction relative to the first housing 21, while the lower end portion of the handle may be supported by the first housing 21 so as to be rotatable around a rotation axis extending in the left-right direction. In any case, the battery-mounting part 29 may be disposed on a lower end portion of the first housing 21 (below the motor 31). The elastic members disposed between the first housing 21 and the handle may be changed like the elastic members 501 and 505. Further, the second housing 25 or the handle need not be elastically connected to the first housing 21.

The shape, number and arrangement position of the battery-protection parts 280 may be appropriately changed. For example, the battery-protection part 280 may be formed not by a portion of the housing 20, but as a separate member from the housing 20 and connected to the housing 20. Further, the battery-protection part 280 may be omitted.

Portions (sliding parts) of the first housing 21 and the second housings 25 which are slidable in the front-rear direction relative to each other are not limited to the upper sliding part 51 and the lower sliding part 52. For example, only one sliding part may be provided in the up-down direction. Further, a plurality of sliding parts may be provided in positions different from those of the above-described embodiment, or the sliding part may be omitted.

In the above-described embodiment, the hammer 1 includes a pair of the right and left dynamic vibration reducers 7. However, the structure, arrangement position and number of the dynamic vibration reducers 7 may be appropriately changed, or the dynamic vibration reducers 7 may be omitted.

In the above-described embodiment, in order to perform soft no-load control of the motor 31, the detection unit 6 is provided which detects pressing of the tool accessory 91 against a workpiece by detecting movement of the lever 61. In place of the detection unit 6, however, a detecting mechanism (such as an acceleration sensor) which is configured to detect pressing of the tool accessory 91 by any other system may be adopted. Further, the drive control may be performed so as not to drive the motor 31 while pressing of the tool accessory 91 is not detected, but to start driving of the motor 31 in response to detection of pressing of the tool accessory 91. Alternatively, the detection unit 6 or other detecting mechanism may be omitted. In other words, it is not necessary to perform drive control of the motor 31 according to whether the tool accessory 91 is pressed or not.

DESCRIPTION OF NUMERALS

1: electric hammer, 20: housing, 201: inlet, 21: first housing, 22: barrel part, 221: tool holder, 23: crank housing, 231: rear-wall part, 233: base part, 24: motor housing, 243: inner-rear-wall part, 245: base part, 246: screw, 25: second housing, 26: grip part, 261: trigger, 263: switch, 27: upper housing, 271: rear-wall part, 273: abutment part, 28: lower housing, 280: battery-protection part, 281: front protection part, 282: rear protection part, 285: connection part, 286: wireless-communication unit, 287: recess, 29: battery-mounting part, 291: hook-engagement part, 293: guide rail, 30: controller, 300: control circuit, 301: wiring, 31: motor, 310: motor body, 315: motor shaft, 33: fan, 35: speed-change-dial unit, 4: driving mechanism, 40: motion-converting mechanism, 41: crank shaft, 42: connecting rod, 43: piston, 45: cylinder, 46: striking mechanism, 461: striker, 463: impact bolt, 465: air chamber, 501: elastic member, 504: elastic member, 505: elastic member, 51: upper sliding part, 511: lower end surface, 513: upper end surface, 52: lower sliding part, 521: guide rail, 523: guide groove, 531: stopper part, 533: projection, 6: detection unit, 61: lever, 610: lever arm, 611: first end portion, 612: second end portion, 615: cylindrical part, 62: magnet, 63: Hall sensor, 631: board, 65: holder, 651: base, 653: lever-support part, 655: stopper projection, 67: coil spring, 7: dynamic vibration reducer, 71: weight, 711: large-diameter part, 713: small-diameter part, 72: spring, 721: front spring, 723: rear spring, 725: spring-receiving member, 73: housing part, 731: front space, 733: rear space, 74: first support part, 741: passage, 743: passage, 744: through hole, 745: through hole, 75: second support part, 76: sleeve, 761: O-ring, 762: O-ring, 77: cap, 771: projection, 772: stopper pin, 773: O-ring, 775: groove, 91: tool accessory, 93: battery, 930: corner region, 931: hook, 933: button, 935: guide groove, 97: auxiliary handle, A1: driving axis, A2: rotation axis, A3: rotation axis, A4: rotation axis

What is claimed is:

1. An impact tool, comprising:

a motor;

a driving mechanism configured to linearly drive a tool accessory along a driving axis by power of the motor, the driving axis defining a front-rear direction of the impact tool;

a housing that houses the motor and the driving mechanism; and at least one dynamic vibration reducer, each of the at least one dynamic vibration reducer including a weight, a front spring in front of the weight, a rear spring behind the weight and a housing part, the weight being linearly movable in the front-rear direction, the weight, the front spring and the rear spring being housed in the housing part, wherein:

the driving mechanism includes:

a crank shaft configured to rotate by power of the motor;

a cylinder extending along the driving axis in the front-rear direction; and a piston configured to reciprocate along the driving axis within the cylinder in response to rotation of the crank shaft;

the housing includes:

a motor housing that houses the motor;

a crank housing that houses the crank shaft; and a barrel part that (i) is in front of the crank housing and (2) houses the cylinder;

a first part of the barrel part that is integral with a remainder of the barrel part is a portion of the housing part;

a first part of the crank housing that is integral with a remainder of the crank housing is another portion of the housing part;

the housing part includes a cylindrical member that extends in the front-rear direction and that houses at least a portion of the weight;

the first part of the barrel part and the first part of the crank housing are spaced in the front-rear direction and support the cylindrical member;

the cylindrical member is held by the housing by a biasing force of at least one of the front spring and the rear spring;

the first part of the barrel part (i) has a cylindrical shape with a closed end and (ii) receives an end of the front spring such that the closed end receives a biasing force of the front spring.

2. The impact tool as defined in claim 1, wherein:

the motor includes a motor shaft rotatable around a rotation axis;

the rotation axis is orthogonal to the driving axis and defines an up-down direction of the impact tool;

the motor housing is on a lower side of the crank housing; and the crank housing and the motor housing are fixedly connected by screws, between the first part of the barrel part and the first part of the crank housing in the front-rear direction.

3. The impact tool as defined in claim 1, wherein either one of the first part of the barrel part and the first part of the crank housing is configured as a spring-receiving part configured to receive a biasing force of the at least one of the front spring and the rear spring.

4. The impact tool as defined in claim 1, wherein the at least one dynamic vibration reducer includes two dynamic vibration reducers that are symmetrical relative to a plane that contains the driving axis.

5. The impact tool as defined in claim 1, wherein:

an internal space of the housing part includes a first space in front of the weight and a second space behind the weight;

the first part of the barrel part has a first air passage providing communication between an internal space of the barrel part and the first space; and the first part of the crank housing has a second air passage providing communication between an internal space of the crank housing and the second space.

6. The impact tool as defined in claim 1, wherein:

the first part of the crank housing has a cylindrical shape; and the cylindrical member is inside the first part of the crank housing and supported by the first part of the crank housing.

7. The impact tool as defined in claim 6, wherein the cylindrical member is biased rearward relative to the first part of the barrel part by the at least one of the front spring and the rear spring and held in abutment with a stopper in the housing.

8. The impact tool as defined in claim 7, wherein:

an internal space of the housing part includes a first space in front of the weight and a second space behind the weight;

the first part of the barrel part has a first air passage providing communication between an internal space of the barrel part and the first space; and the first part of the crank housing has a second air passage providing communication between an internal space of the crank housing and the second space.

9. The impact tool as defined in claim 8, wherein:

the stopper is configured to position the cylindrical member in the circumferential direction relative to the first part of the barrel part and the first part of the crank housing by engaging with a portion of the cylindrical member.

10. The impact tool as defined in claim 6, wherein the first part of the barrel part, the first part of the crank housing and the cylindrical member are co-axial.

11. The impact tool as defined in claim 1, wherein the first part of the barrel part is co-axial with the cylindrical member and the front spring.

12. An impact tool, comprising:

a motor;

a driving mechanism configured to linearly drive a tool accessory along a driving axis by power of the motor, the driving axis defining a front-rear direction of the impact tool;

a housing that houses the motor and the driving mechanism; and at least one dynamic vibration reducer, each of the at least one dynamic vibration reducer including a weight, at least one spring and a housing part, the weight being linearly movable in the front-rear direction, the at least one spring being at least either in front of or behind the weight, the weight and the at least one spring being housed in the housing part, wherein:

the driving mechanism includes:

a crank shaft configured to rotate by power of the motor;

a cylinder extending along the driving axis in the front-rear direction; and a piston configured to reciprocate along the driving axis within the cylinder in response to rotation of the crank shaft;

the housing includes:

a motor housing that houses the motor;

a crank housing that houses the crank shaft; and a barrel part that (i) is in front of the crank housing and (2) houses the cylinder;

a first part of the barrel part that is integral with a remainder of the barrel part is a portion of the housing part;

a first part of the crank housing that is integral with a remainder of the crank housing is another portion of the housing part;

the housing part includes a cylindrical member that extends in the front-rear direction and that houses at least a portion of the weight;

the first part of the barrel part and the first part of the crank housing are spaced in the front-rear direction and support the cylindrical member;

the cylindrical member is a cylinder having an open front end and a closed rear end;

the first part of the barrel part has a recess that opens rearwards;

the first part of the crank housing (i) has a cylindrical shape and (ii) is rearward of the first part of the barrel part; and the cylindrical member is supported such that a front end portion of the cylindrical member is in the recess of the first part of the barrel part and another portion of the cylindrical member that is rearward of the front end portion is in the first part of the crank housing.

13. The impact tool as defined in claim 12, wherein:

the at least one spring includes a front spring in front of the weight and a rear spring behind the weight;

a front end of the front spring is received by a bottom of the recess of the first part of the barrel part; and a rear end of the rear spring is received by the closed rear end of the cylindrical member.

* * * * *